US007980584B2

(12) United States Patent
Goldstein

(10) Patent No.: US 7,980,584 B2
(45) Date of Patent: Jul. 19, 2011

(54) PORTABLE COMMODE, SHOWER AND BATH WHEELCHAIR APPARATUS

(76) Inventor: Eric J. Goldstein, Tucson, AZ (US)

( * ) Notice: Subject to any disclaimer, the term of this patent is extended or adjusted under 35 U.S.C. 154(b) by 987 days.

(21) Appl. No.: 11/836,680

(22) Filed: Aug. 9, 2007

(65) Prior Publication Data

US 2008/0036181 A1 Feb. 14, 2008

Related U.S. Application Data

(60) Provisional application No. 60/821,923, filed on Aug. 9, 2006.

(51) Int. Cl.
*A47K 3/12* (2006.01)
*A61G 5/08* (2006.01)

(52) U.S. Cl. ..... 280/657; 280/304.1; 4/560.1

(58) Field of Classification Search ..... 280/288.4, 280/304.1, 642, 643, 647, 648, 650, 657; 5/81.1 R, 81.1 HS; 4/560.1; 297/344.1
See application file for complete search history.

(56) References Cited

U.S. PATENT DOCUMENTS

| | | | | | |
|---|---|---|---|---|---|
| 2,503,199 | A * | 4/1950 | Goldblatt et al. | ..... | 108/129 |
| 4,288,124 | A * | 9/1981 | Hamilton | ..... | 297/233 |
| 4,779,883 | A * | 10/1988 | Paduano et al. | ..... | 280/304.1 |
| 5,277,438 | A * | 1/1994 | Chuang | ..... | 280/42 |
| 5,282,284 | A * | 2/1994 | Brantman et al. | ..... | 5/81.1 HS |
| 6,182,304 | B1 * | 2/2001 | Freeberg | ..... | 4/560.1 |
| 6,669,287 | B1 * | 12/2003 | DeLilla | ..... | 297/243 |
| 2006/0236449 | A1 * | 10/2006 | Hammer et al. | ..... | 4/560.1 |

* cited by examiner

*Primary Examiner* — Frank B Vanaman
(74) *Attorney, Agent, or Firm* — Dale F. Regelman; Quarles & Brady LLP

(57) ABSTRACT

A portable commode, shower, and bath wheelchair apparatus comprising a first support frame, a second support frame, a mechanical interface interconnecting the first support frame to the second support frame thereby forming a first contiguous support rail and a second contiguous support rail. A seat assembly is slidingly attached to both the first contiguous support rail and to the second contiguous support rail.

8 Claims, 20 Drawing Sheets

140
561
510
560
512
514
542
544
524
520
522
532
530
574
590b
572
536
570
534
554
590a
552
584b
584a
586c
582a
582b
580
586a
586b
586d
586

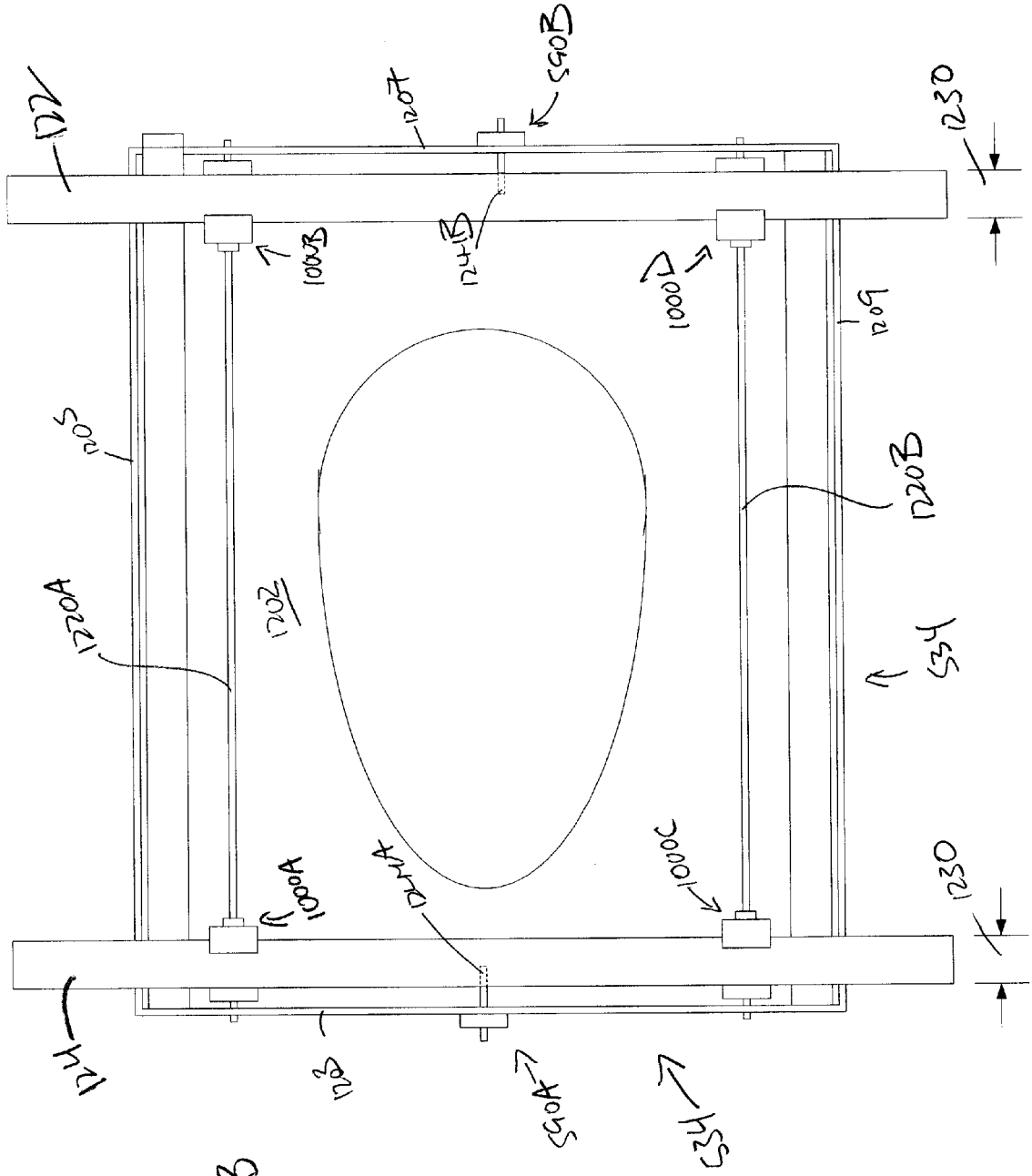
1230
1000C
1220B
1000A
1230
1000B
1000D
1204
1202
1205
1207
1204B
1202
1205
1204A
1202
1205
1207
1204
1202
1205
1207
1204B
1000B
1000D
1220B
1230
1000A
1000C
1230
1202
1205
1207
1204A 124
124A
122A
120A
122
120
122B
120B
124

PORTABLE COMMODE, SHOWER AND BATH WHEELCHAIR APPARATUS

CROSS-REFERENCE TO RELATED APPLICATIONS

This application claims priority from a U.S. Provisional Application having Ser. No. 60/821,923 filed Aug. 9, 2006.

FIELD OF THE INVENTION

This invention relates to a portable commode, shower and bath wheelchair apparatus.

BACKGROUND OF THE INVENTION

When using prior art apparatus and methods, persons using wheelchairs usually require assistance when using the bathroom, including the toilet and shower. Few prior art devices allow for the seamless transition from bed to toilet to shower or bathtub and back again. These apparatus are typically comprised of a commode chair with a seat that can slide along an adjoining track system, over the barrier of the shower or bathtub, to position the person over the shower or bathtub.

The track systems employed have either been fixed to the shower or bathtub or have been supported on one side by the commode chair and on the other side by two support members. Fixation of the track system to the shower or bathtub does not enable the track system to be transported to another location. Reliance on the commode chair to support the track system can present stability problems during the transfer, which can result in injury to the person transferred.

SUMMARY OF THE INVENTION

The invention comprises a portable commode, shower, and bath wheelchair apparatus, and a method using that apparatus. Applicant's apparatus comprises a first support frame comprising a first support rail, a second support rail, and four first leg assemblies, a second support frame comprising a third support rail, a fourth support rail, and four second leg assemblies, and a mechanical interface comprising a first interface assembly comprising a fifth support rail, and a second interface assembly comprising a sixth support rail.

The first interface assembly can be releasably attached, without using any tools, to the first support rail and to the third support rail, such that the first support rail and the fifth support rail and the third support rail comprise a first contiguous support rail. The second interface assembly can be releasably attached, without using any tools, to the second support rail and to the fourth support rail, such that the second support rail and the fifth support rail and the fourth support rail comprise a second contiguous support rail. A seat assembly comprising a plurality of attachment assemblies can be slidingly attached to both the first contiguous support rail and to the second contiguous support rail.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
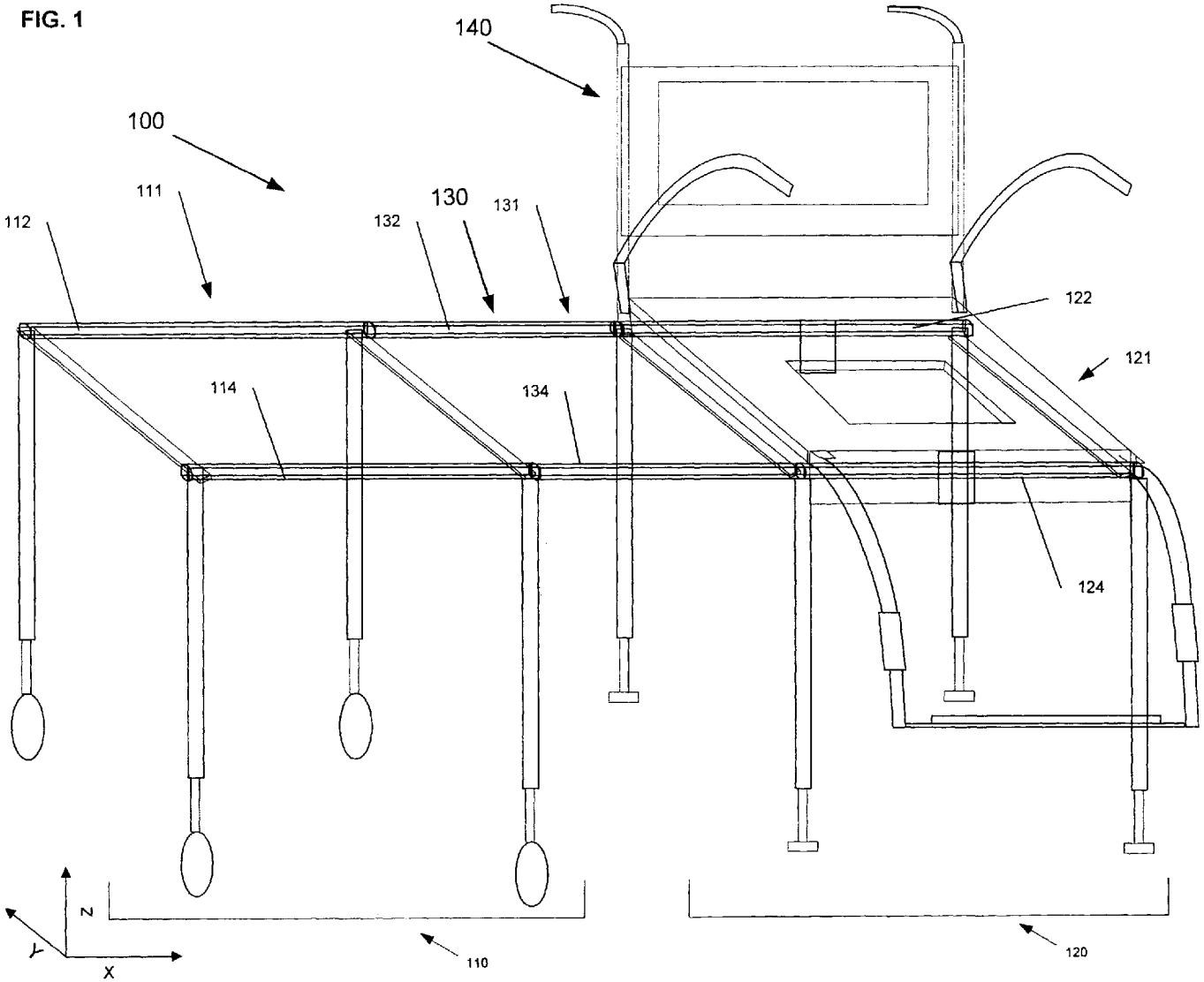
FIG. 1 is a perspective view showing Applicant's first support frame, mechanical interface, and second support frame, wherein Applicant's seat assembly is shown slidingly disposed on the second support frame.

Referring now to FIG. 1, Applicant's apparatus 100 comprises movable first support frame 110, second support frame 120, mechanical interface 130, and seat assembly 140. In the illustrated embodiment of FIG. 1, first support frame 110 further comprises a first set of parallel rails 111, comprising support rail 112 and support rail 114. Interface 130 comprises a second set of parallel rails 131, comprising support rail 132 and support rail 134. Second frame assembly 120 comprises a third set of parallel rails 121, comprising support rail 122 and support rail 124. As described more fully herein, movable first support frame comprises a plurality of wheels.

In the illustrated embodiment of FIG. 1, the first set of rails 111, second set of rails 131, and third set of rails 121 are aligned such that seat assembly 140 can be moved bidirectionally from the first set of rails 111 to the second set of rails 131, and bidirectionally from the second set of rails 131 to the third set of rails 121. Thus, seat assembly 140 can be slideably moved from first support frame 110 across interface 130 and onto second frame 120. Similarly, seat assembly 140 can be slideably moved from second frame 120 across interface 130 and onto first support frame 110.

Interface 130 is releasably interconnected by a springpin lock mechanism with first support frame 110 such that the first set of rails 111 is aligned with the second set of rails 131. Moreover, second support frame assembly 120 is releasably interconnected by a springpin lock mechanism with interface 130 such that the third set of rails 121 is aligned with the second set of rails 131.

In certain embodiments, support rail 112 comprises a rigid material selected from the group consisting of metal, an engineering plastic, wood, or combinations thereof. By "engineering plastic," Applicant means a polymeric material comprising a tensile modulus of about 500,000 psi or greater, and/or a flexural modulus of about 500,000 psi or greater. Such polymeric materials include, without limitation, one or more polyamides, one or more polyimides, one or more polyetheretherketones, one or more cured epoxy resins, and the like.

In certain embodiments, Applicant's engineering plastic material comprises a polymeric material in combination with one or more fillers, wherein those one or more fillers comprise, for example and without limitation, continuous glass strands, woven fiber glass mats, chopped glass, and the like. In certain embodiments, Applicant's engineering plastic comprises a filament wound composite comprising one or more reinforcing fiber matrices such as for example fiber glass, carbon fiber, and the like, in combination with one or more cross-linked polymeric resins such as for example a cured epoxy resin.

In certain embodiments, support rail 112 comprises a tubular member having an outside diameter between about ⅞ inch and about 1 inch. In certain embodiments, support rail 112 comprises a tubular member having a length between about 16 inches and about 19 inches. In certain embodiments, support rail 112 comprises a solid member having a circular cross-section.

In certain embodiments, support rail 114 comprises a rigid material selected from the group consisting of metal, an engineering plastic, wood, or combinations thereof. In certain embodiments, support rail 114 comprises a tubular member having an outside diameter between about ⅞ inch and about 1 inch. In certain embodiments, support rail 114 comprises a tubular member having a length between about 16 inches and about 19 inches. In certain embodiments, support rail 114 comprises a solid member having a circular cross-section.

In certain embodiments, support rail 122 comprises a rigid material selected from the group consisting of metal, an engineering plastic, wood, or combinations thereof. In certain embodiments, support rail 122 comprises a tubular member having an outside diameter between about ⅞ inch and about 1 inch. In certain embodiments, support rail 122 comprises a tubular member having a length between about 16 inches and about 19 inches. In certain embodiments, support rail 122 comprises a solid member having a circular cross-section.

In certain embodiments, support rail 124 comprises a rigid material selected from the group consisting of metal, an engineering plastic, wood, or combinations thereof. In certain embodiments, support rail 124 comprises a tubular member having an outside diameter between about ⅞ inch and about 1 inch. In certain embodiments, support rail 124 comprises a tubular member having a length between about 16 inches and about 19 inches. In certain embodiments, support rail 124 comprises a solid member having a circular cross-section.

In certain embodiments, support rail 132 comprises a rigid material selected from the group consisting of metal, an engineering plastic, wood, or combinations thereof. In certain embodiments, support rail 132 comprises a tubular member having an outside diameter between about ⅞ inch and about 1 inch. In certain embodiments, support rail 132 comprises a tubular member having a length between about 11 inches and about 18 inches. In certain embodiments, support rail 132 comprises a solid member having a circular cross-section.

In certain embodiments, support rail 134 comprises a rigid material selected from the group consisting of metal, an engineering plastic, wood, or combinations thereof. In certain embodiments, support rail 134 comprises a tubular member having an outside diameter between about ⅞ inch and about 1 inch. In certain embodiments, support rail 134 comprises a tubular member having a length between about 11 inches and about 18 inches. In certain embodiments, support rail 134 comprises a solid member having a circular cross-section.

Figure 2:
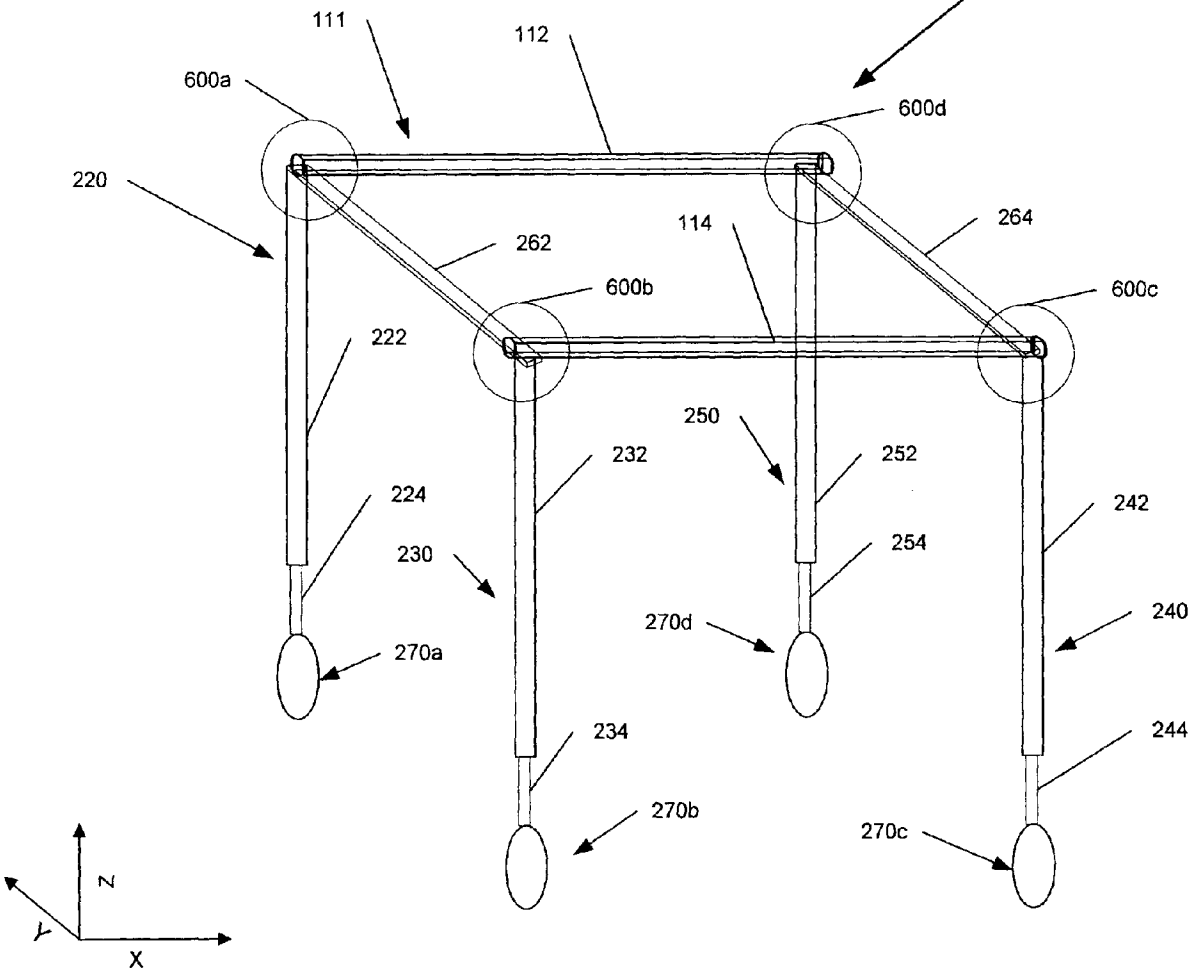
FIG. 2 is a perspective view of Applicant's first support frame, wherein a plurality of leg assemblies are shown in a first configuration wherein those leg assemblies extend outwardly from a set of parallel support members.

Referring to FIG. 2, first support frame 110 comprises support rail 112, support rail 114, bracing member 262, bracing member 264, first leg assembly 220, second leg assembly 230, third leg assembly 240, fourth leg assembly 250, wheel assembly 270*a*, wheel assembly 270*b*, wheel assembly 270*c*, wheel assembly 270*d*, hinge assembly 600*a*, hinge assembly 600*b*, hinge assembly 600*c*, and hinge assembly 600*d*. In the illustrated embodiment of FIG. 2, first leg assembly 220 comprises a first member 222 and a second member 224. The second member 224 is telescopically received by first member 222, wherein the length of member 224 extending outwardly from member 222 can be adjusted.

Similarly, members 234, 244, and 254, are telescopically received by second members 232, 242, and 252, respectively. The length of members 234, 244, and 254, extending outwardly from members 232, 242, and 252, respectively, can be adjusted. Because the leg heights of support frame 110 are adjustable by varying the lengths of members 224, 234, 244, and/or 254, it is possible to accommodate seat assembly 140 to match various toilet bowl heights, bathtub/shower stall heights, and the height of other objects, such as, without limitations, bed heights.

In certain embodiments, members 222, 224, 232, 234, 242, 244, 252, and 254, are formed from a rigid material selected from the group consisting of metal, an engineering plastic, wood, or combinations thereof. In certain embodiments, members 222, 232, 242, and 252 comprise a tubular members having an outside diameter between about ⅞ inch and about 1 inch. In certain embodiments, members 222, 232, 242, and 252, comprise a tubular member having a length between about 8 inches and about 14 inches. In certain embodiments, members 222 232, 242, and 252 comprise a solid member having a circular cross-section.

In certain embodiments, members 224, 234, 244, and 254, comprise a tubular member having an outside diameter between about ¾ inch and about ⅞ inch. In certain embodiments, members 224, 234, 244, and 254, comprise a tubular member having a length between about 6 inches and about 10 inches. In certain embodiments, members 224, 234, 244, and 254, comprise a solid member having a circular cross-section.

In certain embodiments, wheel assembly 270*a*, wheel assembly 270*b*, wheel assembly 270*c*, and wheel assembly 270*d* comprise a 4-inch diameter wheel. In other embodiments, wheel assembly 270*a*, wheel assembly 270*b*, wheel assembly 270*c*, and wheel assembly 270*d* comprise a wheel having a diameter less than 4 inches. In yet other embodiments, wheel assembly 270*a*, wheel assembly 270*b*, wheel assembly 270*c*, and wheel assembly 270*d* comprise a wheel having a diameter greater than 4 inches. In certain embodiments, wheel assembly 270*a*, wheel assembly 270*b*, wheel assembly 270*c*, and wheel assembly 270*d* comprise castoring wheel assemblies.

In other embodiments, wheel assembly 270*a* and wheel assembly 270*d* comprise 15 inch diameter solid rubber wheels with locking brakes which may be interchanged with other wheel assemblies. In these embodiments, the user can grasp one or both of the wheels while seated, and cause moveable assembly 110 in combination with seat assembly 140 to move forwardly, rearwardly, or pivot in either direction, without the assistance of another.

In the illustrated embodiment of FIG. 2, vertical leg member 222 and vertical leg member 252 are cambered to provide stability, and to prevent tipping of the first support frame 110. Vertical leg member 222 and vertical leg member 252 are cambered rearwardly at a substantially 15-degree angle. By "substantially 15-degree angle," Application means 15 degrees+/−2 degrees. The cambering adds stability to the chair rendering it safer and provides the ability to add "rear lean" affording additional comfort for the user. By "rear lean," Applicant means the ability for a user to lean backward in the chair by adding length to front vertical leg members 232 and 242 using their telescoping features.

In the illustrated embodiment of FIG. 2, first set of vertical leg members 220 are pivotally interconnected with support rail 112 by hinge 600*a* described hereinafter. Second set of vertical leg members 230 are pivotally interconnected with support rail 114 by hinge 600*b*. Third set of vertical leg members 240 are pivotally interconnected with support rail 114 by hinge 600*c*. Fourth set of vertical leg members 250 are pivotally interconnected with support rail 112 by hinge 600*d*.

In the illustrated embodiment of FIG. 2, bracing member 262 and bracing member 264 are substantially perpendicular to set of parallel rails 111. By "substantially perpendicular," Applicant means the angle formed between bracing member 262 and support rail 112 is 90 degrees+/−10 degrees. In certain embodiments, first bracing member 262 is interconnected with first set of vertical leg members 220 and second set of vertical leg members 230 by conventional attachment means, such as welding, plastic welding, mechanical fasteners, and the like. In certain embodiments, second bracing member 264 is interconnected with third set of vertical leg members 240 and fourth set of vertical leg members 250 by conventional attachment means, such as welding, plastic welding, mechanical fasteners, and the like.

In certain embodiments, first bracing members 262 and 264 comprise a rigid material selected from the group consisting of metal, an engineering plastic, wood, or combinations thereof. In certain embodiments, bracing members 262 and 264 comprise a planar member having a length between about 15 inches and about 18 inches. In certain embodiments, bracing members 262 and 264 comprise a width between about 1.5 inches and about 2 inches. In certain embodiments, bracing member 262 comprises a solid member having a rectangular cross-section. In other embodiments, bracing member 262 comprises a circular or oval cross-section.

Figure 3:
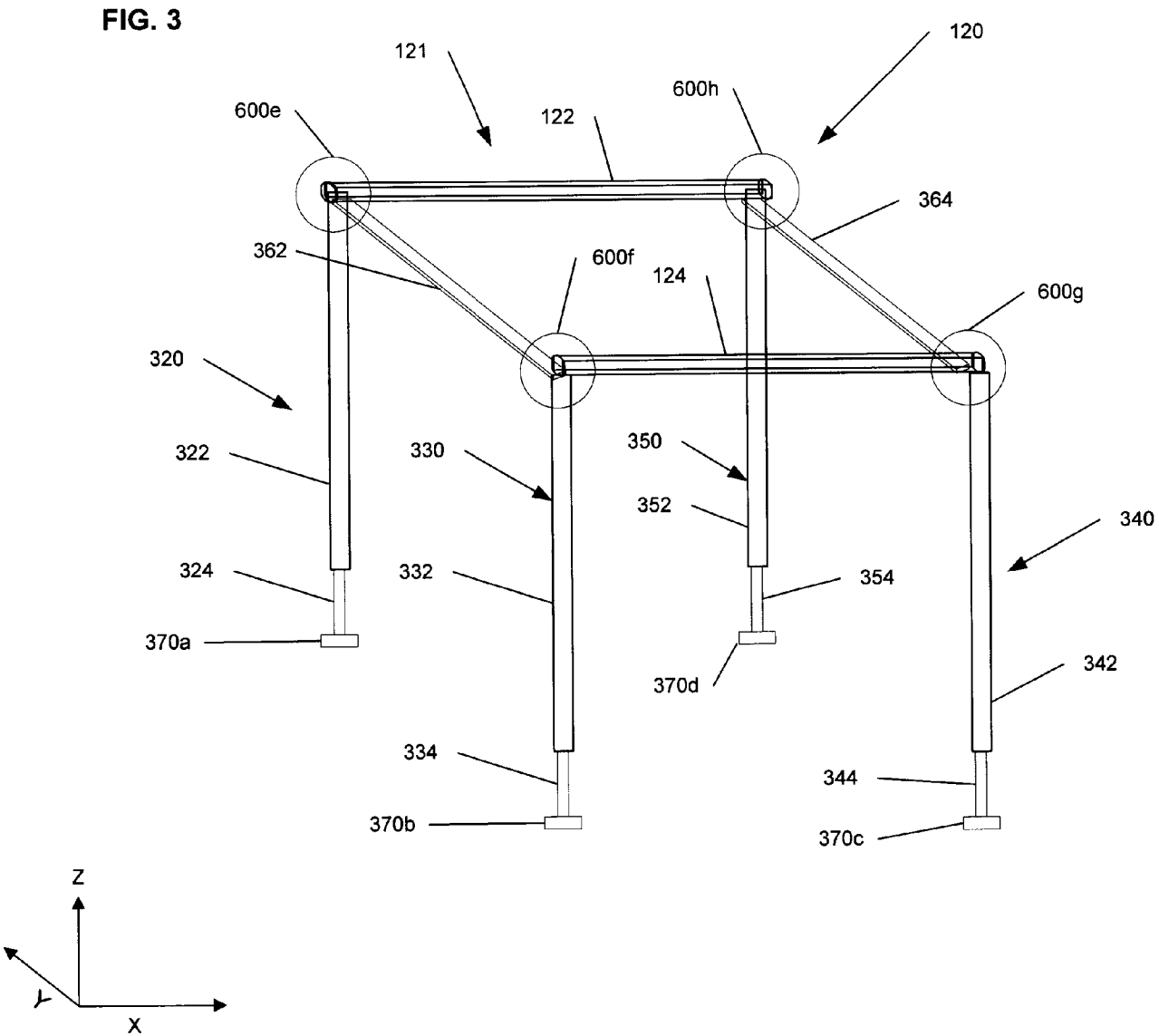
FIG. 3 is a perspective view of Applicant's second support frame, wherein a plurality of leg assemblies are shown in a first configuration wherein those leg assemblies extend outwardly from a set of parallel support members.

Referring to FIG. 3, second support frame 120 comprises support rail 122, support rail 124, bracing member 362, bracing member 364, first leg assembly 320, second leg assembly 330, third leg assembly 340, fourth leg assembly 350, adjustable non-skid glide assembly 370*a*, adjustable non-skid glide assembly 370*b*, adjustable non-skid glide assembly 370*c*, adjustable non-skid glide assembly 370*d*, brace bar 380, hinge assembly 600*e*, hinge assembly 600*f*, hinge assembly 600*g*, and hinge assembly 600*h*.

In the illustrated embodiment of FIG. 3, vertical leg members 222, 232, 242 and 252 are cambered to provide stability, and to prevent tipping of the second support frame 120. Vertical leg member 232 and vertical leg member 242 are cambered forwardly at a substantially 15-degree angle. Vertical leg member 222 and vertical leg member 252 are cambered rearwardly at a substantially 15-degree angle. By "substantially 15-degree angle," Application means 15 degrees+/−2 degrees. The cambering adds stability to the chair rendering it safer and provides the ability to add "rear lean" affording additional comfort for the user. By "rear lean," Applicant means the ability for a user to lean backward in the chair by adding length to front vertical leg members 232 and 242 using their telescoping features.

In the illustrated embodiment of FIG. 2, first leg assembly 320 comprises a first member 322 and a second member 324. The second member 324 is telescopically received by first member 322, wherein the length of member 324 extending outwardly from member 322 can be adjusted. A glide 370*a* is disposed on the distal end of member 324.

Similarly, members 334, 344, and 354, are telescopically received by members 332, 342, and 352, respectively. The length of members 334, 344, and 354, extending outwardly from members 332, 342, and 352, respectively, can be adjusted. Glides 370*b*, 370*c*, and 370*d*, are disposed on the distal ends of members 334, 344, and 354, respectively. Because the leg heights of support frame 120 are adjustable by varying the lengths of members 324, 334, 344, and/or 354, it is possible to accommodate seat assembly 140 to match various toilet bowl heights, bathtub/shower stall heights, and the height of other objects, such as, without limitations, bed heights.

In certain embodiments, members 322, 324, 332, 334, 342, 344, 352, and 354, are formed from a rigid material selected from the group consisting of metal, an engineering plastic, wood, or combinations thereof. In certain embodiments, members 322, 332, 342, and 352 each comprise a tubular members having an outside diameter between about ⅞ inch and about 1 inch. In certain embodiments, members 322, 332, 342, and 352, comprise a tubular member having a length between about 8 inches and about 14 inches. In certain embodiments, members 322 332, 342, and 352 comprise a solid member having a circular cross-section.

In certain embodiments, members 324, 334, 344, and 354, comprise a tubular member having an outside diameter between about ⅝ inch and about ⅞ inch. In certain embodiments, members 324, 334, 344, and 354, comprise a tubular member having a length between about 9 inches and about 15 inches. In certain embodiments, members 324, 334, 344, and 354, comprise a solid member having a circular cross-section.

In the illustrated embodiment of FIG. 3, first set of vertical leg members 320 are pivotally interconnected with support rail 122 by hinge 600*e* described hereinafter. Second set of vertical leg members 330 are pivotally interconnected with support rail 124 by hinge 600*f*. Third set of vertical leg members 340 are pivotally interconnected with support rail 124 by hinge 600*g*. Fourth set of vertical leg members 350 are pivotally interconnected with support rail 122 by hinge 600*h*.

In the illustrated embodiment of FIG. 3, bracing member 362 and bracing member 364 are substantially perpendicular to set of parallel rails 121. In certain embodiments, first bracing member 362 is interconnected with first set of vertical leg members 320 and second set of vertical leg members 330 by conventional attachment means, such as welding, plastic welding, mechanical fasteners, and the like. In certain embodiments, second bracing member 364 is interconnected with third set of vertical leg members 340 and fourth set of vertical leg members 350 by conventional attachment means, such as welding, plastic welding, mechanical fasteners, and the like.

In certain embodiments, bracing members 362 and 364 comprise a rigid material selected from the group consisting of metal, an engineering plastic, wood, or combinations thereof. In certain embodiments, bracing members 362 and 364 comprise a planar member having a length between about 15 inch and about 18 inch. In certain embodiments, bracing members 362 and 364 comprise a width between about 1.5 inches and about 2 inches. In certain embodiments, bracing members 362 and 364 comprise a solid member having rectangular cross-section. In other embodiments, bracing members 362 and 364 comprise a circular or oval cross-section.

In certain embodiments, glides 370*a*, 370*b*, 370*c*, and 370*d*, each comprises a rigid material selected from the group consisting of metal, an engineering plastic, wood, or combinations thereof. In certain embodiments, glides 370*a*, 370*b*, 370*c*, and 370*d*, each comprises a member having a height between about ¼ inch and about ½ inch. In certain embodiments, glides 370*a*, 370*b*, 370*c*, and 370*d*, comprises a width between about 1 inch and about 1⅛ inches. In certain embodiments, glides 370*a*, 370*b*, 370*c*, and 370*d*, are sold in commerce by SUPERIOR COMPONENTS.

In the illustrated embodiment of FIG. 3, brace bar 380 comprises a first and second end. First end of brace bar 380 is attached to support rail 122 and second end of brace bar 380 is attached to support rail 124 by conventional attachment means. Brace bar 380 gives the user of the apparatus 100 more ease when using second frame 120 because the seat assembly 140 will not tip or slide off the end of second frame 120.

In certain embodiments, brace bar 380 comprises a rigid material selected from the group consisting of metal, an engineering plastic, wood, or combinations thereof. In certain embodiments, brace bar 380 comprises a planar member having a length between about 15 inches and about 18 inches. In certain embodiments, brace bar 380 has a width between about ¾ inches and about 1.5 inches. In certain embodiments, brace bar 380 comprises a solid member having rectangular cross-section. In other embodiments, brace bar 380 comprises a circular or oval cross-section.

Figure 4:
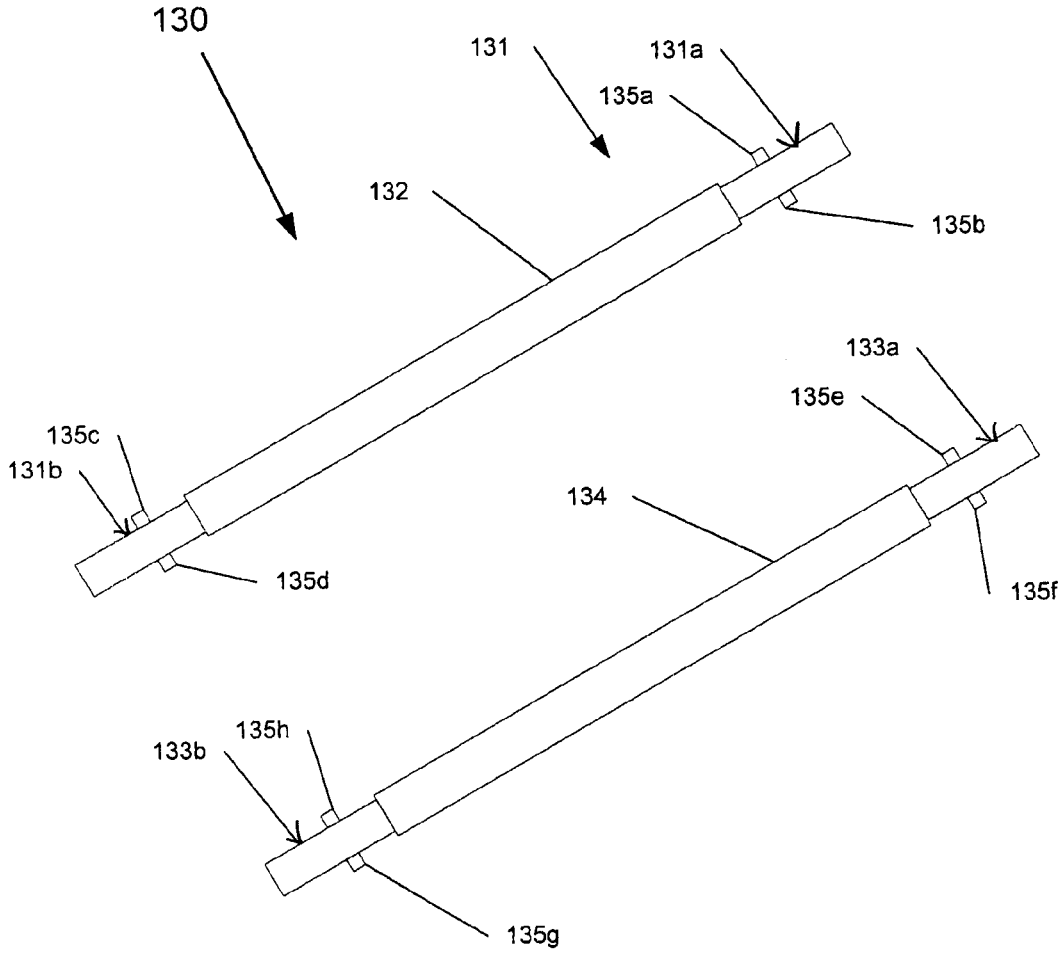
FIG. 4 is a perspective view of Applicant's mechanical interface.

Referring to FIG. 4, mechanical interface 130 comprises a set of parallel support members 132 and 134, in combination with connector 131*a*, connector 131*b*, connector 133*a*, connector 133*b*, tab 135*a*, tab 135*b*, tab 135*c*, tab 135*d*, tab 135*e*, tab 135*f*, tab 135*g*, and tab 135*h*. The elements of mechanical interface 130 can releasably interconnect first support frame 110 to second support frame 120.

In the illustrated embodiment of FIG. 4, connector 131*a*, connector 131*b*, connector 133*a*, and connector 133*b* have an outside diameter that is equal to the inside diameter of support rail 112, support rail 114, support rail 122, and support rail 124. Support rail 112, support rail 114, support rail 122, and support rail 124, are formed to include apertures to accommodate lock tab 135*a*, tab 135*b*, tab 135*c*, tab 135*d*, tab 135*e*, tab 135*f*, tab 135*g*, and tab 135*h*. Tab 135*a*, tab 135*b*, tab 135*c*, tab 135*d*, tab 135*e*, tab 135*f*, tab 135*g*, and tab 135*h* comprise depressible tabs which extend outwardly from connector 131*a*, 131*b*, 133*a*, and 133*b*, respectively. Tab 135*a*, tab 135*b*, tab 135*c*, tab 135*d*, tab 135*e*, tab 135*f*, tab 135*g*, and tab 135*h* comprise springpin devices known in the art.

In certain embodiments, support rails 132 and 134 comprise a rigid material selected from the group consisting of metal, an engineering plastic, wood, or combinations thereof. In certain embodiments, support rails 132 and 134 comprise a tubular member having an outside diameter between about ⅞ inch and about 1 inch. In certain embodiments, support rails 132 and 134 comprise a tubular member having a length between about 12 inches and about 20 inches. In certain embodiments, support rails 132 and 134 each comprise a solid member having a circular cross-section.

In certain embodiments, connector 131*a*, connector 131*b*, connector 133*a*, and connector 133*b*, comprise a rigid material selected from the group consisting of metal, an engineering plastic, wood, or combinations thereof. In certain embodiments, connector 131*a*, connector 131*b*, connector 133*a*, and connector 133*b*, comprise a tubular member having an outside diameter between about ⅝ inch and about ⅞ inch. In certain embodiments, connector 131*a*, connector 131*b*, connector 133*a*, and connector 133*b*, comprise a tubular member having a length between about 3 inch and about 6 inches. In certain embodiments, connector 131*a*, connector 131*b*, connector 133*a*, and connector 133*b*, comprise a solid member having a circular cross-section.

Figure 5A:
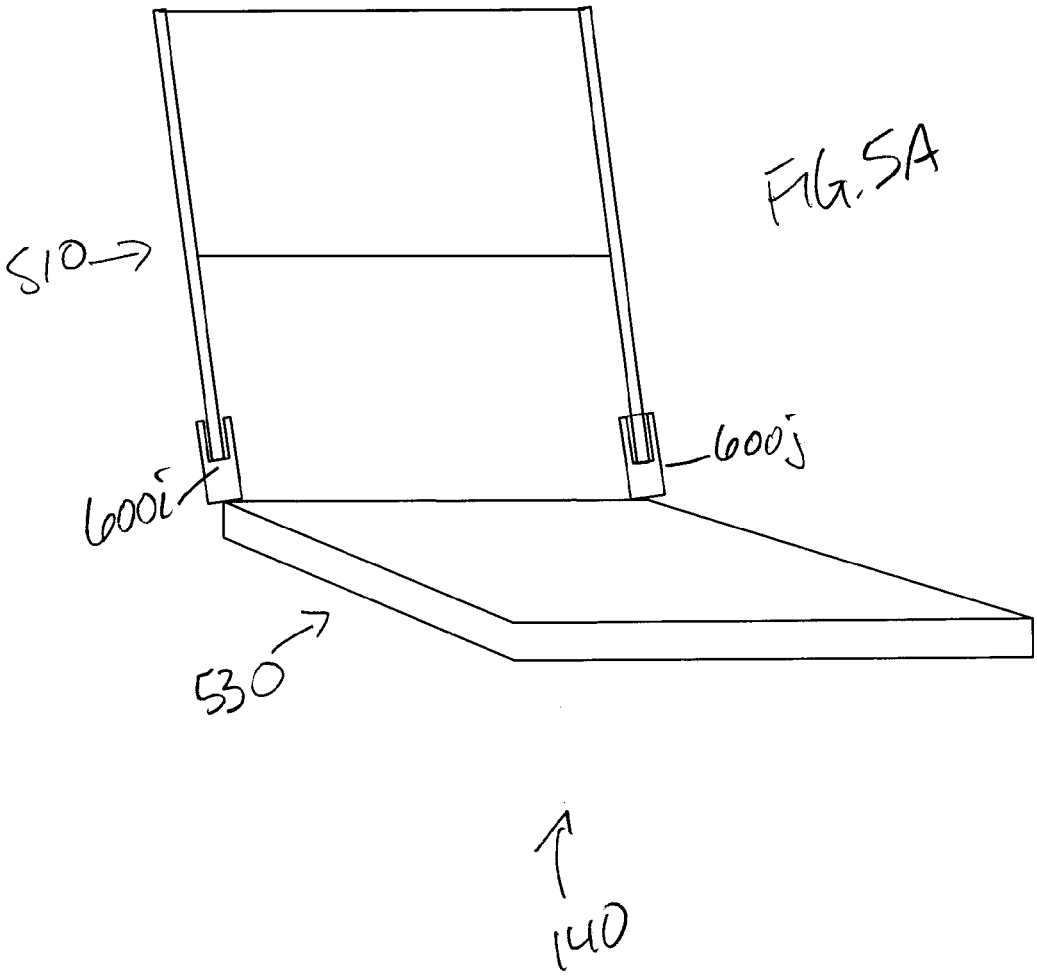
FIG. 5A is a perspective view of Applicant's backrest and seat, wherein the backrest is disposed in an upright configuration.
Figure 5B:
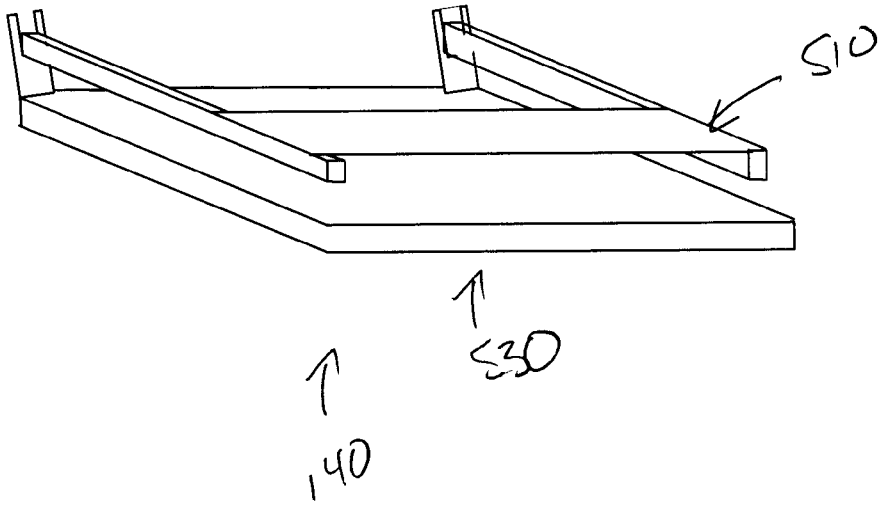
FIG. 5B is a perspective view of Applicant's backrest and seat, wherein the backrest is disposed in a folded configuration.

Referring now to FIGS. 5A and 5B, seat assembly 140 comprises seat 530 and backrest 510 which is hingedly attached to seat 530 using hinges 600*i* and 600*j*. FIG. 5A shows backrest disposed in an upright configuration. FIG. 5B shows backrest 510 in a folded configuration.

Figure 5C:
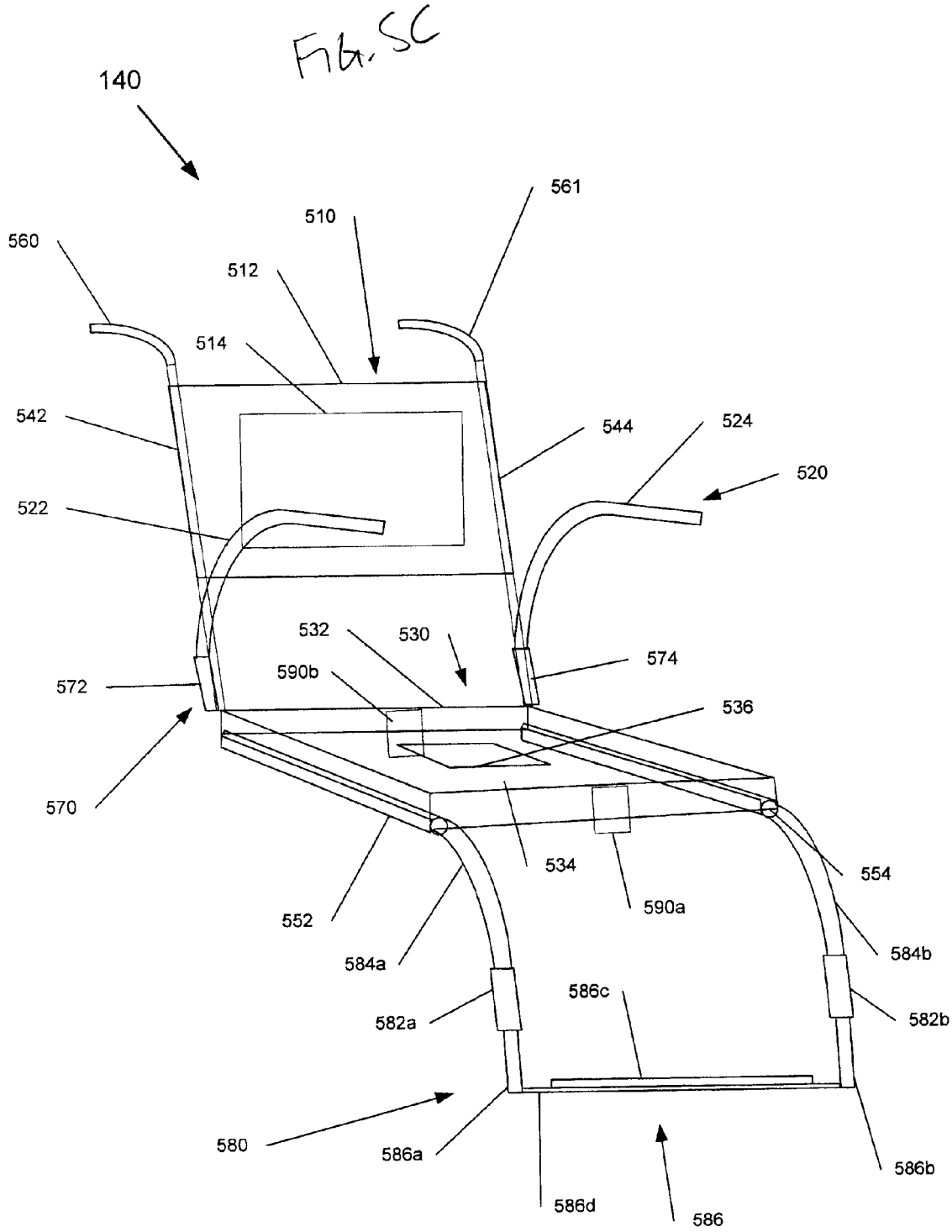
FIG. 5C is a perspective view showing additional elements of Applicant's seat assembly.

Referring to FIG. 5C, seat assembly 140 comprises a backrest 510, a set of armrests 520, a seat 530, a first vertical member 542, a second vertical member 544, a set of push handles 560 and 561, a set of armrest acceptor tubes 570, and a footrest assembly 580. In the illustrated embodiment of FIG. 5C, the backrest 510 comprises a rectangular element 512 and a cushion 514 which is releasably interconnected by conventional attachment means for easy replacement.

Backrest 510 is interconnected to a set of vertical members 542 and 544 by conventional attachment means. In the illustrated embodiment of FIG. 5C, the set of armrests 520 comprises a first armrest 522 and a second armrest 524. In the illustrated embodiment of FIG. 5C, first armrest 522 and second armrest 524 are shown in a first orientation wherein each armrest is pivotally mounted in a set of acceptor tubes 570. First armrest 522 and second armrest 524 are releasably interconnected to first acceptor tube 572 and second acceptor tube 574, respectively. First acceptor tube 572 is mounted to first vertical member 542 by conventional attachment means. Second acceptor tube 574 is mounted to second vertical member 544 by conventional attachment means.

In certain embodiments, rectangular element 512 comprises a rigid material selected from a group consisting of metal, an engineering plastic, wood, or combinations thereof. In certain embodiments, backrest 512 comprises a flat member having a thickness between about ⅛ inch and about ⅝ inch. In certain embodiments, backrest 512 comprises a sheet having a height between about 7 inches and about 10 inches. In certain embodiments, backrest 512 comprises a sheet having a width between about 16 inches and about 18 inches.

In certain embodiments, cushion 514 comprises a flexible foam. In certain embodiments, cushion 514 is sold in commerce by Red Central Foams, S.A., Monterrey, N.L., Mexico under the name vinyl-coated foam cushion. In certain embodiments, cushion 514 has a thickness between about ¾ inch and about 1½ inches. In certain embodiments, cushion 514 comprises a width between about 15 inches and about 17 inches. In certain embodiments, cushion 514 comprises a height between about 7 inches and about 10 inches. In certain embodiments, cushion 514 is contoured. Cushion 514 is releasably interconnected to element 512 by a mechanical attachment means for easy replacement. By "mechanical attachment means," Applicant means hook and loop fasteners, snaps, zippers, or combinations thereof, and the like. Cushions of various shapes and sizes will attach universally to the seat base to accommodate users of varying sizes.

In certain embodiments, armrests 522 and 524 comprise a rigid material selected from the group consisting of metal, an engineering plastic, wood, or combinations thereof. In certain embodiments, armrests 522 and 524 comprise a tubular member having an outside diameter between about ⅞ inch and about 1 inch. In certain embodiments, the distal ends of armrest 522 and armrest 524 extend about 14 inches from the back of seat. In certain embodiments, armrests 522 and 524 comprise a solid member having a circular cross-section.

In certain embodiments, acceptor tubes 572 and 574 comprise a rigid material selected from a group consisting of metal, an engineering plastic, wood, or combinations thereof. In certain embodiments, acceptor tubes 572 and 574 comprise a tubular member having an outside diameter between about 1 inch and about 1.5 inches. In certain embodiments, acceptor tubes 572 and 574 comprise a tubular member having a length between about 2 inches and about 4 inches. In certain embodiments, acceptor tubes 572 and 574 comprise a solid member having a circular cross-section.

In the illustrated embodiment of FIG. 5C, a first vertical member 542 comprises a push pin mechanism at the top of the vertical member 542 so that push handle 560 can be locked into place. The vertical member 542 is interconnected to seat form 530 at the back portion of the seat form 530 at the back two corners by hinge assembly 600 (see FIGS. 6A, 6B, 7A, 7B) as to achieve a seat assembly in which a user may sit. Vertical member 542 is connected to backrest 510 by conventional attachment means.

In the illustrated embodiment of FIG. 5C, a second vertical member 544 comprises a push pin mechanism at the top of the vertical member 544 so that push handle 561 can be locked into place. The vertical member 544 is interconnected to seat form 530 at the back portion of the seat form 530 at the back two corners by hinge assembly 600 (see FIGS. 6A, 6B, 7A, 7B) as to achieve a seat assembly in which a user may sit. Vertical member 544 is connected to backrest 510 by conventional attachment means.

In certain embodiments, vertical members 542 and 544 comprise a rigid material selected from the group consisting of metal, an engineering plastic, wood, or combinations thereof. In certain embodiments, vertical members 542 and 544 comprise a tubular member having an outside diameter between about ⅞ inch and about 1 inch. In certain embodiments, vertical members 542 and 544 comprise a tubular member having a length between about 15 inches and about 18 inches. In certain embodiments, vertical member 544 comprises a solid member having a circular cross-section.

In the illustrated embodiment of FIG. 5C, seat assembly 530 comprises a cushion 532 and a seat frame 534. Cushion 532 is releasably attached to seat frame 534 by conventional attachment means for easy replacement. As one skilled in the art would appreciate, the aperture 536 in cushion 532 and seat board 534 allow for ease of use over a toilet. In other embodiments, cushion 532 and seat board 534 comprises a rectangular form. Seat frame 534 is interconnected to hinge mechanism 600 at the back of the seat frame 534 by conventional attachment means. In certain embodiments, frame 534 comprises a rigid material selected from a group consisting of metal, an engineering plastic, wood, or combinations thereof.

Figure 12A:
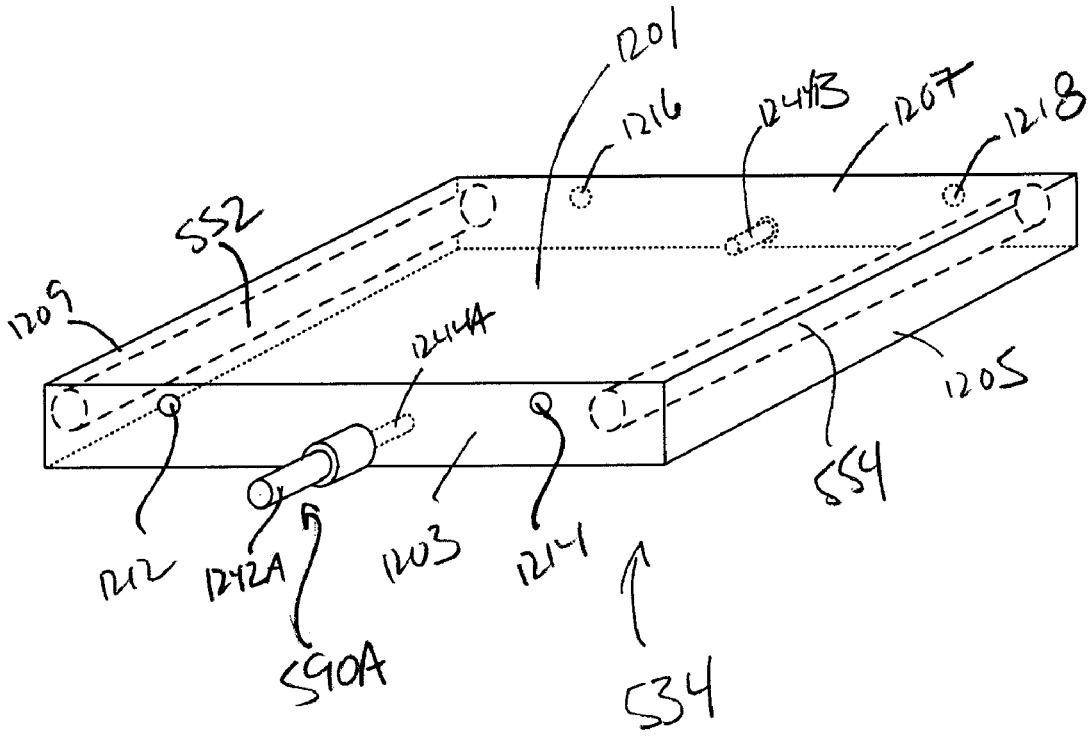
FIG. 12A is perspective view of Applicant's seat frame.
Figure 12:
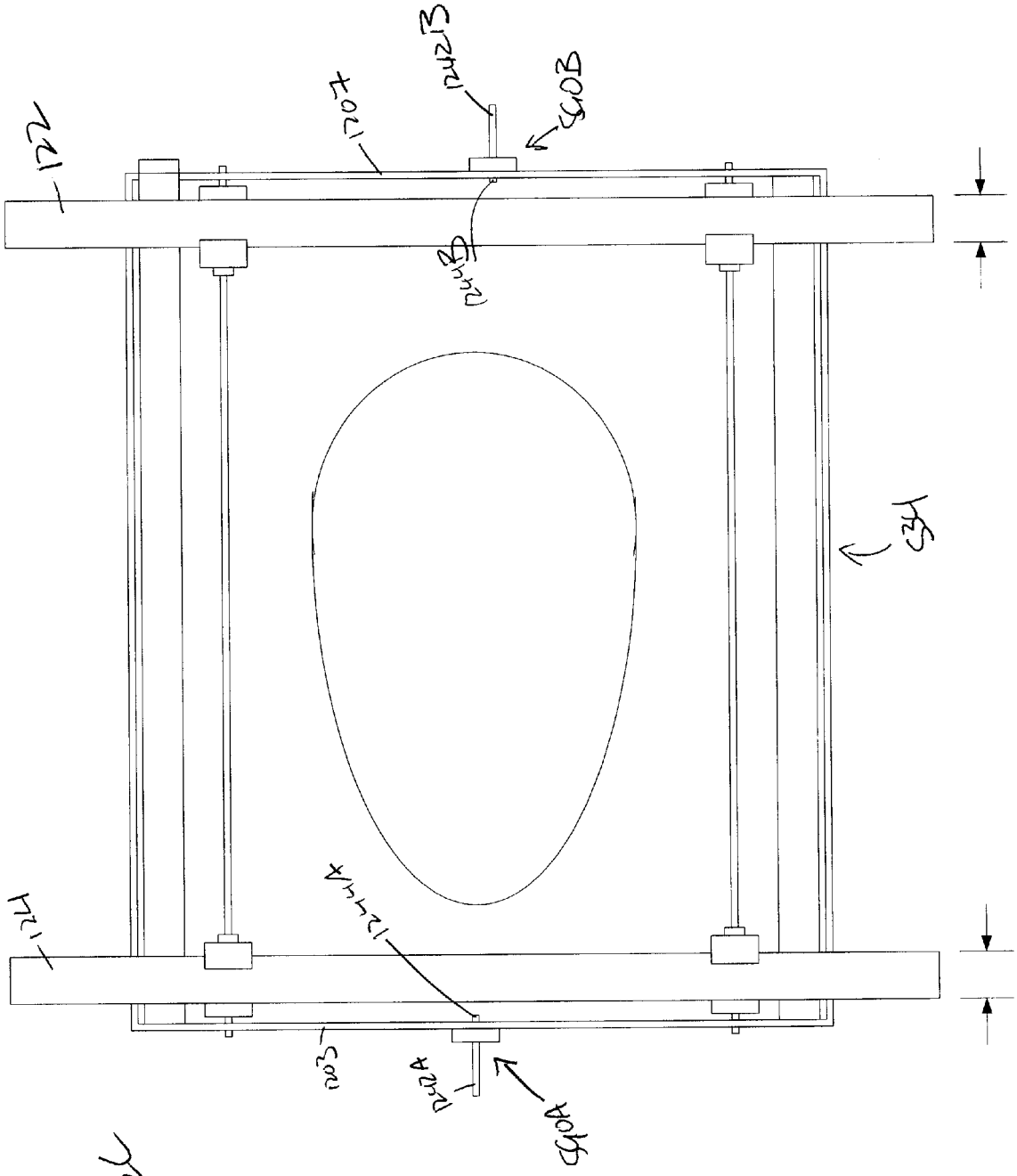
FIG. 12B is a bottom view showing Applicant's seat frame attached to a set of support rails, wherein a set of locking assemblies are in a locked configuration.
FIG. 12C is a bottom view showing Applicant's seat frame attached to a set of support rails, wherein a set of locking assemblies are in an unlocked configuration.

Referring now to FIGS. 5 and 12A, in certain embodiments top portion 1201 comprises a flat member having a thickness between about ⅛ inch and about ⅜ inch. In certain embodiments, top portion 1201 comprises a member having a width between about 18 inches and about 20 inches. In certain embodiments, top portion 1201 comprises a member having a width between about 18 inches and about 20 inches. In certain embodiments, top portion 1201 is formed from 0.090" 5052 grade aluminum sheet.

In certain embodiments, cushion 532 comprises a flexible foam. In certain embodiments, cushion 532 is sold in commerce by Red Central Foams, S.A., Monterrey, N.L., Mexico under the name vinyl-coated foam cushion. In certain embodiments, cushion 532 has a thickness between about ¾ inch and about 1.5 inches. In certain embodiments, cushion 532 comprises a sheet having a width between about 17 inches and about 20 inches. In certain embodiments, cushion 532 comprises a sheet having a depth between about 18 inches and about 20 inches. Cushions of various shapes and sizes will attach universally to the seat base to accommodate users of varying sizes. Cushion 532 will be releasably interconnected to cushion 532 by a mechanical attachment means for easy replacement. By "mechanical attachment means," Applicant means hook and loop fasteners, snaps, zippers, or combinations thereof.

In illustrated embodiment of FIG. 5C, the set of push handles 560 and 561 are releasably interconnected to vertical member 542 and vertical member 544, respectively. The push handles 560 and 561 allow for a second person to have ease of movement when pushing or pulling from behind.

Referring to FIG. 5C, push handle 560 and push handle 561 can independently move in two positions. The first position is the push/pull position where a second person can grip the handles and push or pull from behind. The second position is an inward position that aligns the push handles with the backrest 510 for ease in folding the wheelchair for storage.

In certain embodiments, push handles 560 and 561 comprise a rigid material selected from the group consisting of metal, an engineering plastic, wood, or combinations thereof. In certain embodiments, push handles 560 and 561 comprise a tubular member having an outside diameter between about ¾ inch and about 1 inch. In certain embodiments, push handles 560 and 561 extend between about 4 inches and 6 inches from the backrest 510. In certain embodiments, push handles 560 and 561 comprise a tubular member with a length between about 9 inches and about 12 inches. In certain embodiments, push handles 560 and 561 are bent at a substantially 90 degree angle. By "substantially 90 degree angle," Applicant means a 90 degree angle+/−5 degrees. In certain embodiments, push handles 560 and 561 comprise a solid member having a circular cross-section.

In the illustrated embodiment of FIG. 5C, footrest assembly 580 comprises a first attachment member 582*a*, second attachment member 584*a*, and footrest pad 586. The second attachment member 584*a* is contoured so as not to have any sharp edges. The first attachment member 582*a* comprises a first end and a second end. The first end of attachment member 582*a* is releasably interconnected with second attachment member 584*a* by a push pin lock mechanism. The first attachment member 582*a* is telescopically received in the first end by second attachment member 584*a*. First attachment member 582*a* is releasably extendable by a springpin lock mechanism. Second attachment member 584*a* is attached to seat board 534 by a push pin lock mechanism.

In the illustrated embodiment of FIG. 5C, footrest assembly 580 comprises first attachment member 582*b*, second attachment member 584*b*, and footrest pad 586. The second attachment member 584*b* is contoured so as not to have any sharp edges. The first attachment member 582*b* comprises a first end and a second end. The first end of attachment member 582*b* is releasably interconnected with second attachment member 584*b* by a push pin lock mechanism. The first attachment member 582*b* is telescopically received in the first end by second attachment member 584*b*. First attachment member 582*b* is releasably extendable by a springpin lock mechanism. Second attachment member 584*b* is attached to seat board 534 by a push pin lock mechanism.

Referring to FIG. 5C, footrest pad 586 comprises a skid-free flat plate 586*c* attached to a first attachment member 586*a* on one end of the skid-free plate and second attachment member 586*b* on the other end by a supporting member 586*d*. First attachment member 586*a* is attached to member 582*a* by a push pin lock mechanism. Second attachment member 586*b* is attached to member 582*b* by a push pin lock mechanism. Skid-free plate 586*c* is attached to supporting member 586*d* by conventional attachment means. First attachment member 586*a* and second attachment member 586*b* are attached to supporting member 586*d* by conventional attachment means.

In certain embodiments, attachment members 582*a* and 584*a* comprise a rigid material selected from the group consisting of metal, an engineering plastic, wood, or combinations thereof. In certain embodiments, attachment members 582*a* and 584*a* comprise a tubular member having an outside diameter between about ⅞ inch and about 1 inch. In certain embodiments, attachment members 582*a* and 584*a* comprise a tubular member having a length between about 4 attachment members 582*a* and 584*a* comprise member 582*a* comprises a solid member having a circular cross-section.

In certain embodiments, attachment members 582*b* and 584*b* comprise a rigid material selected from the group consisting of metal, an engineering plastic, wood, or combinations thereof. In certain embodiments, attachment members 582*b* and 584*b* comprise a tubular member having an outside diameter between about ⅞ inch and about 1 inch. In certain embodiments, attachment members 582*b* and 584*b* comprise a tubular member having a length between about 4 inches and about 8 inches. In certain embodiments, attachment members 582*b* and 584*b* comprise a solid member having a circular cross-section.

In certain embodiments, attachment members 586*a* and 586*b* comprise a rigid material selected from the group consisting of metal, an engineering plastic, wood, or combinations thereof. In certain embodiments, attachment members 586*a* and 586*b* comprise a tubular member having an outside diameter between about ⅞ inch and about 1 inch. In certain embodiments, attachment members 586*a* and 586*b* comprise a tubular member having a length between about 1 inch and about 3 inches. In certain embodiments, attachment members 586*a* and 586*b* comprise a solid member having a circular cross-section.

In certain embodiments, skid-free plate 586*c* comprises a rigid material selected from a group consisting of metal, an engineering plastic, wood, or combinations thereof. In certain embodiments, skid-free plate 586*c* comprises a rectangular flat member with a length between about 14 inches and 16 inches. In certain embodiments, skid-free plate 586*c* comprises a width between about 5 inches and 7 inches. The top surface of the plate 586*c* comprises a non-slip surface material selected from the group consisting of metal, an engineering plastic, or combinations thereof. In certain embodiments, skid-free plate 586*c* is oval shaped or the like thereof.

In certain embodiments, supporting member 586*d* comprises a rigid material selected from a group consisting of metal, an engineering plastic, wood, or combinations thereof. In certain embodiments, supporting member 586*d* comprises a flat rectangular member with a length between about 16 inches and about 20 inches.

Referring now to FIGS. 5 and 12A, seat assembly 530 comprises frame 534, first support member 552, and second support member 554. Seat frame 534 comprises a top portion 1201, and four sides 1203, 1205, 1207, and 1209, attached to top portion 1201 and extending downwardly therefrom to form a 5-sided enclosure. Cushion 532 is removeably attached to top portion 1201. Side 1203 is formed to include apertures 1212 and 1214 extending therethrough. Side 1207 is formed to include apertures 1216 and 1218 extending therethrough.

Figure 6A:
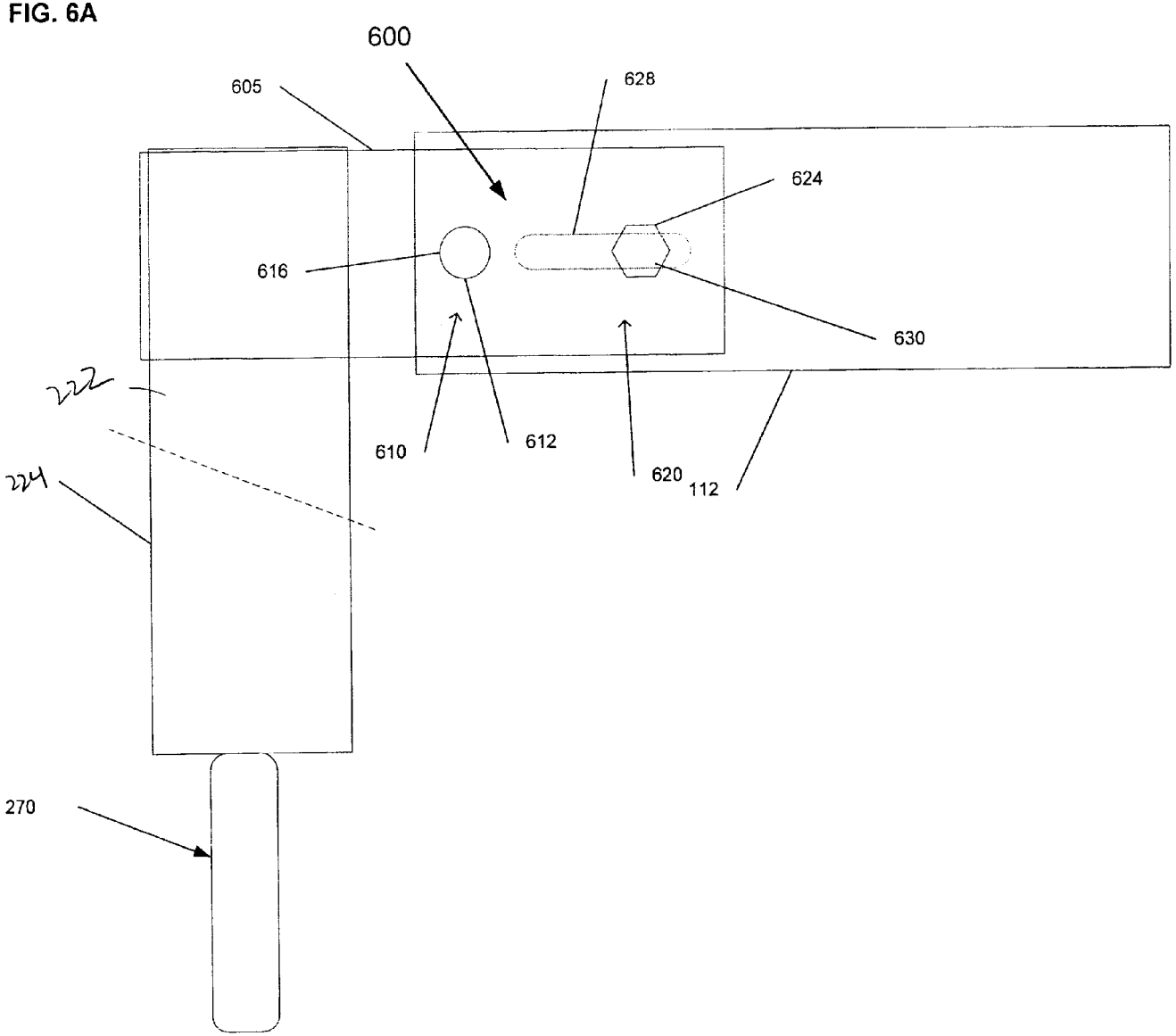
FIG. 6A is a top view showing Applicant's hinge assembly in a locked position.

FIG. 6A is a side view showing hinge assembly 600 in the locked position. In the illustrated embodiment of FIG. 6A, hinge assembly 600 comprises pin assembly 610, assembly 620, and interconnecting member 605. In the illustrated embodiment of FIG. 6A, pin assembly 610 comprises a pin 612 and an aperture 616. In certain embodiments, pin assembly further includes attachment cable 614 (see FIG. 6B). In the illustrated embodiment of FIG. 6A, horizontal member 112 and vertical member 222 are connected by pin assembly 610, assembly 620, and interconnecting member 605.

In the illustrated embodiment of FIG. 6A, interconnecting member 605 is attached to the top end of vertical member 222 by conventional attachment means. In the illustrated embodiment of FIG. 6A, the inside diameter of horizontal member 112 and the outer diameter of interconnecting member 605 are equal such that a first end of interconnecting member 605 can be slideably inserted into one end of horizontal member 112. In the illustrated embodiment of FIG. 6A, interconnecting member 605 comprises an aperture 628 that is dimensioned such that assembly 620 is movable bidirectionally within interconnecting member 605.

In certain embodiments, interconnecting member 605 comprises a rigid material selected from the group consisting of metal, an engineering plastic, wood, or combinations thereof. In certain embodiments, interconnecting member 605 comprises a tubular member having an outside diameter between about 1 inch and about 1½ inches. In certain embodiments, interconnecting member 605 comprises a tubular member having a length between about 2 inches and about 3 inches. In certain embodiments, interconnecting member 605 comprises a solid member having a circular cross-section.

In certain embodiments, pin 612 comprises a rigid material selected from the group consisting of metal, an engineering plastic, wood, or combinations thereof. In certain embodiments, pin 612 comprises a tubular member having an outside diameter between about ⅛ inch and about ¼ inch. In certain embodiments, pin 612 comprises a tubular member having a length between about 1 inch and about 1½ inches. In certain embodiments, pin 612 comprises a solid member having a circular cross-section. In certain embodiments, pin 612 comprises a 1.25 inch grip range. In certain embodiments, pin 612 is stainless steel. In certain embodiments, the optional attachment cable 614 (see FIG. 6B) comprises a flexible material.

Figure 6B:
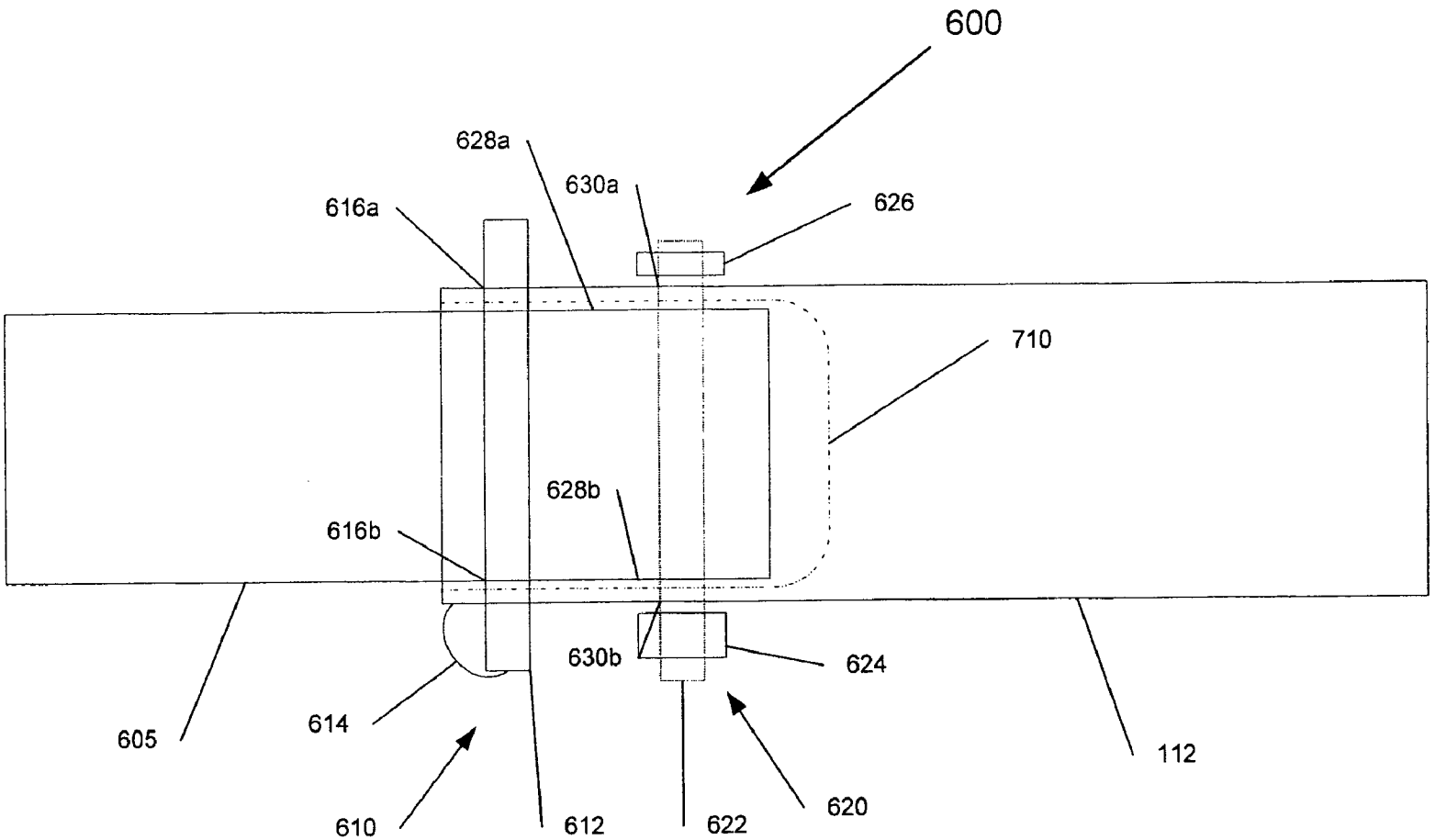
FIG. 6B is a top view showing Applicant's hinge assembly in a locked position.

FIG. 6B is a top view showing hinge assembly 600 in the locked position. In the illustrated embodiment of FIG. 6B, assembly 620 comprises a bolt 622, a first nut 624, a second nut 626, and opposing apertures 630*a* and 630*b*. In the illustrated embodiment of FIG. 6B, tubular member 112 and interconnecting member 605 have a set of opposing circular apertures 630*a* and 630*b* so that horizontal member 112 and interconnecting member 605 can be releasably attached by bolt 622, a first nut 624, and a second nut 626.

In the illustrated embodiment of FIG. 6B, assembly 610 comprises a pin 612 and opposing apertures 616*a* and 616*b*. In the illustrated embodiment of FIG. 6B, tubular member 112 and interconnecting member 605 have a set of opposing circular apertures 616*a* and 616*b* so that horizontal member 112 and interconnecting member 605 can be locked by pin 612.

In the illustrated embodiment of FIG. 6B, the horizontal member 112 and the interconnecting member 605 are formed to include opposing apertures 616*a* and 616*b* so that pin assembly 610 can be locked by pushing the pin 612 through apertures 616*a* and 616*b* so that the horizontal member 112 and vertical leg member 222 form a substantially ninety degree angle in the locked position. By "substantially ninety degree angle," Applicant means a ninety degree angle +/−10 degrees formed between the horizontal member 112 and the vertical leg member 222. In the illustrated embodiment of FIG. 6B, interconnecting member 605 is formed to include an opposing oval-shaped apertures 628*a* and 628*b* so that horizontal member 112 and interconnecting member 605 are dimensioned such that a first end of interconnecting member 605 can be slideably inserted into one end of horizontal member 112. Interconnecting member 605 can be positioned within horizontal member 112 such that apertures 630*a*, 628*a*, 630*b*, and 628*b* are aligned. Bolt 622 can be inserted through these aligned apertures.

In certain embodiments, bolt 622 comprises a rigid material selected from the group consisting of metal, an engineering plastic, or combinations thereof. In certain embodiments, bolt 622 comprises a tubular member having an outside diameter between about ¼ inch and about ½ inch. In certain embodiments, bolt 622 comprises a tubular member having a length between about 1 inch and about 1½ inch. In certain embodiments, bolt 622 comprises a ¼-20 stainless steel carriage bolt. In certain embodiments, bolt 622 comprises a solid member having a circular cross-section.

Figure 7A:
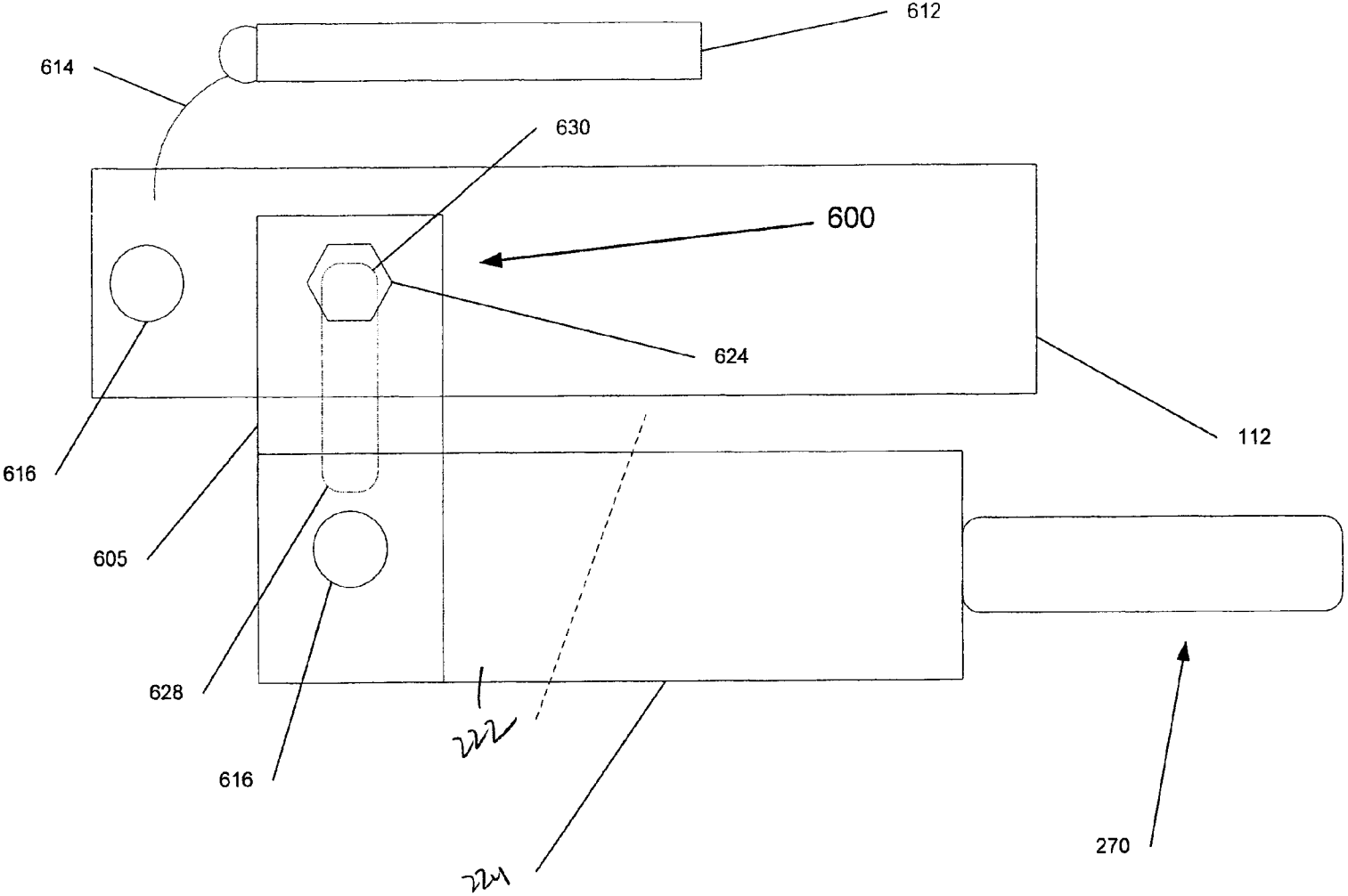
FIG. 7A is a side view showing Applicant's hinge assembly in an unlocked and folded position.

FIG. 7A is a side view showing hinge assembly 600 in the unlocked and folded position. In the illustrated embodiment of FIG. 7A, pin 612 is removed from aperture 616 to allow horizontal member 112 and interconnecting member 605 to separate. Interconnecting member 605 can be slideably moved from within horizontal member 112 and rotated in a downward motion into a folded and portable form by way of aperture 710, (see FIG. 7B). Attachment cable 614 is attached to horizontal member 112 on first end and attached to pin 612 on the second end. When pin 612 is removed from aperture 616, attachment cable 614 allows pin 612 to hang from horizontal member 112. By attaching pin 612 to horizontal member 112 there are no loose parts when collapsing apparatus 100 for storage and portability.

Figure 7B:
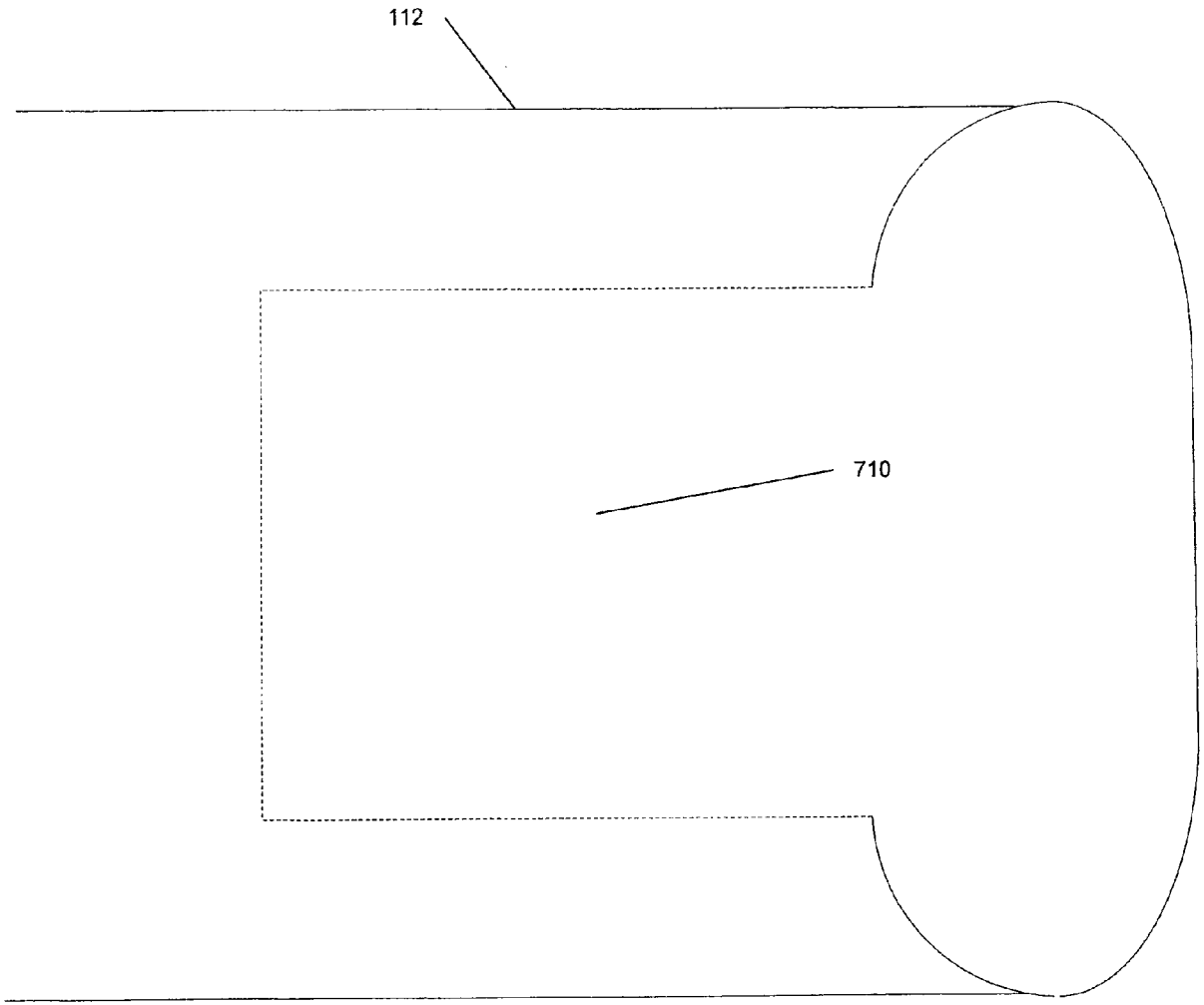
FIG. 7B shows an aperture formed in the ends of each of the support members disposed in Applicant's first support frame and second support frame.

Referring to FIG. 7B, horizontal member 112 comprises an aperture 710 dimensioned such that interconnecting member 605 can be rotated in a downward motion into a folded and portable form (see FIG. 7A).

Figure 8A:
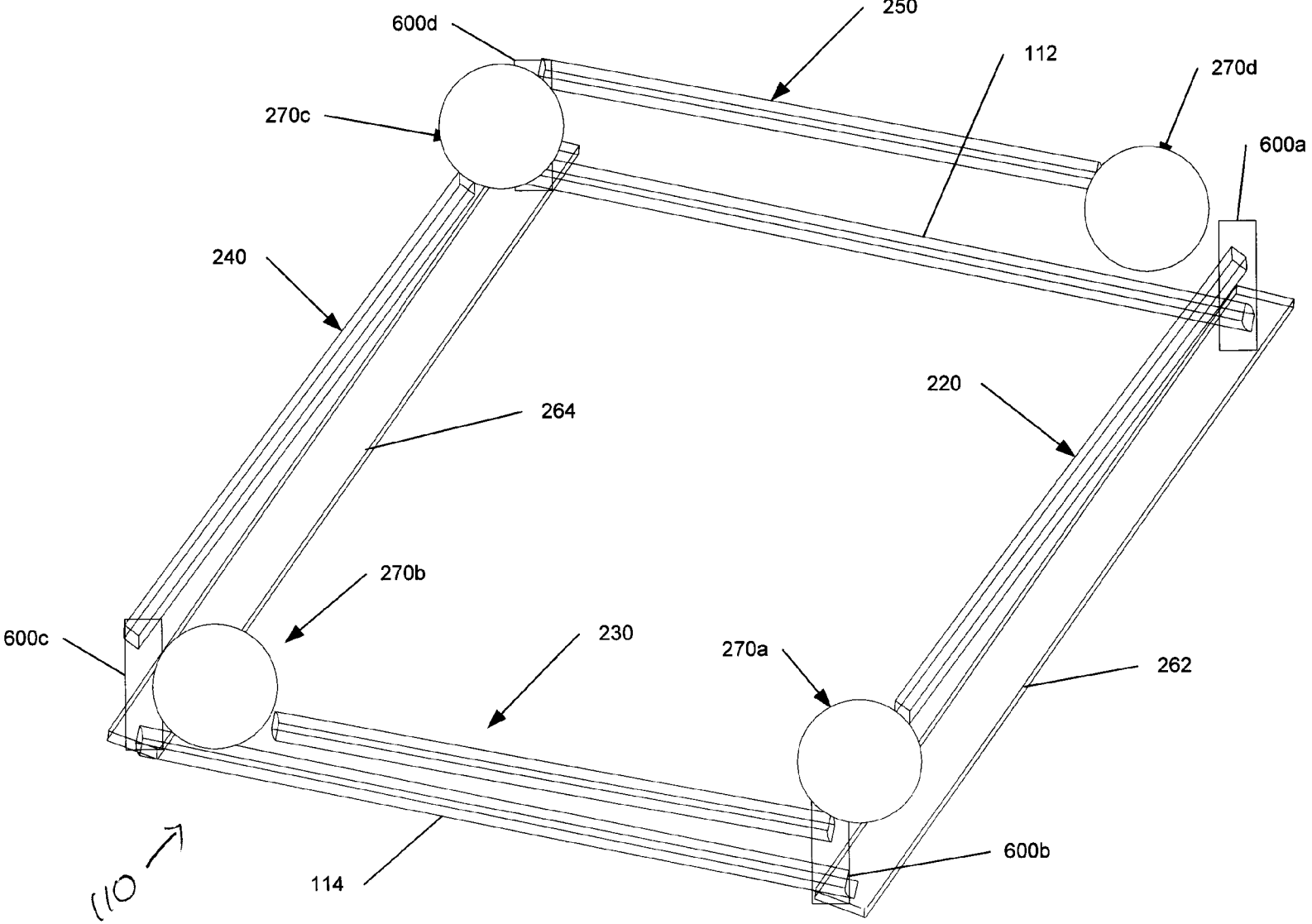
FIG. 8A shows the leg assemblies of Applicant's first support frame disposed in a folded configuration wherein those leg assemblies are disposed within the first support frame.

Referring to FIG. 8A, support frame 110 is shown in a folded configuration for ease of transport. The upright configuration of FIG. 2 can be transformed into the folded configuration of FIG. 8A by removing a locking pin 612 (FIG. 7A) from each of hinge 600*a*, hinge 600*b*, hinge 600*c*, and hinge 600*d*, pivoting vertical member 220 inwardly about ninety degrees, pivoting vertical member 230 inwardly about ninety degrees, pivoting vertical member 240 inwardly about ninety degrees, and pivoting vertical member 250 inwardly about ninety degrees.

Figure 8B:
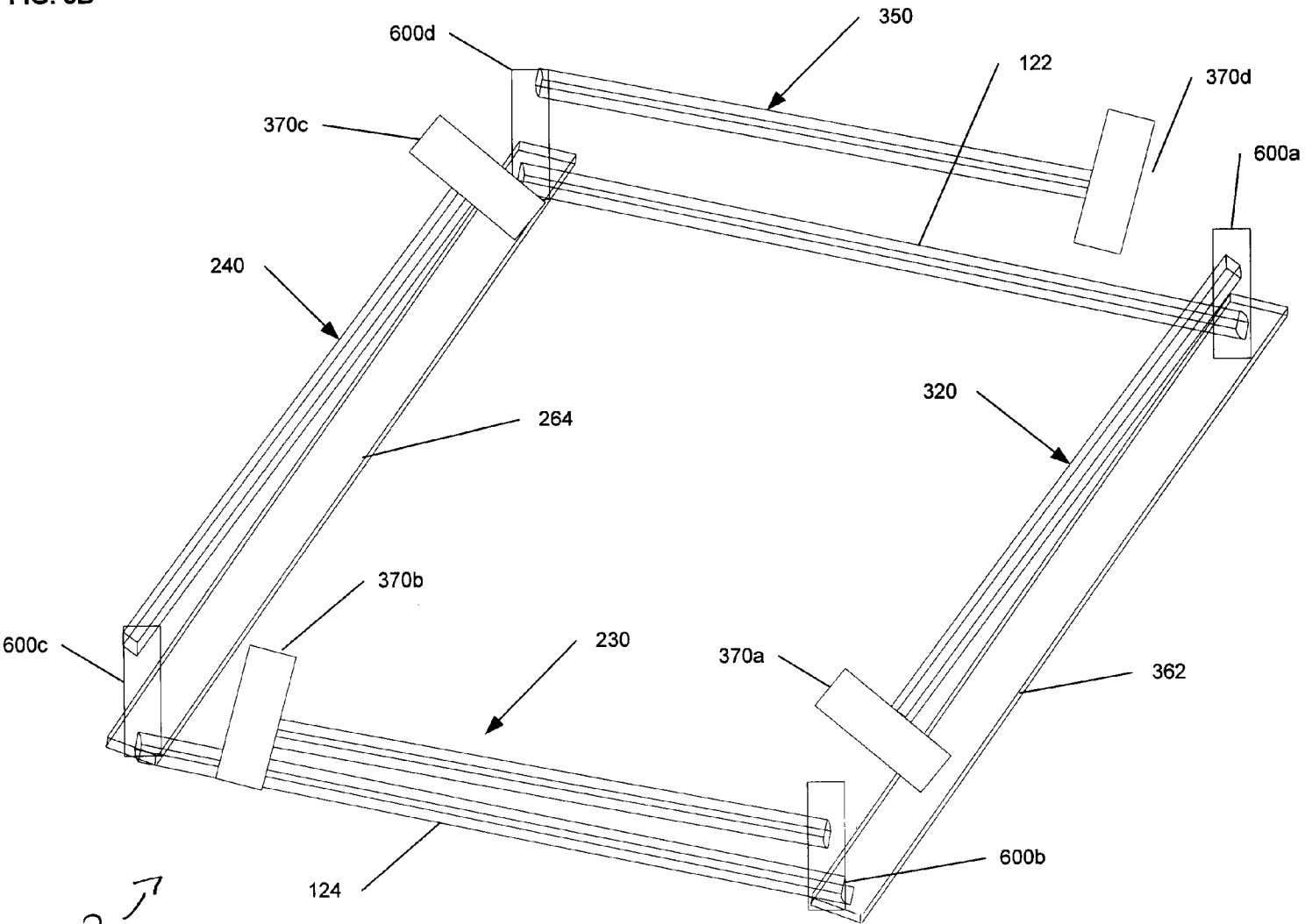
FIG. 8B shows the leg assemblies of Applicant's second support frame disposed in a folded configuration wherein those leg assemblies are disposed within the second support frame.

Referring to FIG. 8B, support frame 120 is shown in a folded configuration for ease of transport. The upright configuration of FIG. 3 can be transformed into the folded configuration of FIG. 8B by removing a locking pin 612 (FIG. 7A) from each of hinge 600*a*, hinge 600*b*, hinge 600*c*, and hinge 600*d*, pivoting vertical member 320 inwardly about ninety degrees, pivoting vertical member 330 inwardly about ninety degrees, pivoting vertical member 340 inwardly about ninety degrees, and pivoting vertical member 350 inwardly about ninety degrees.

Support frame 110 in the folded configuration of FIG. 8A, support frame 120 in the folded configuration of FIG. 8B, the elements of mechanical interface 130 (FIG. 4), and seat assembly 140 in the folded configuration of FIG. 5B, can be easily disposed in, and carried in, a carrying case. Applicants' apparatus 100 may be easily disassembled and reassembled, without the use of any tools. The individual elements of Applicant's apparatus 100 can be transported in the carrying case enabling the user to travel to places which may be otherwise inaccessible without Applicant's apparatus.

Referring to FIGS. 5, 12A, 12B, and 12C, lock assembly 590*a* comprises a plate-mount, hand retractable spring and ball disposed on front side 1203. Lock assembly 590A comprises release member 1242A which can be disposed in a first position or a second position. In the illustrated embodiment of FIGS. 12A and 12B, release member 1242A is shown in a second and locking position wherein locking pin 1244A extends inwardly from side 1203. When locking pin 1244A is inserted into an aperture formed in member 114 or member 124, seat assembly 140 is prevented from sliding in either direction or disengaging from support frame 110 or support frame 120, respectively.

In the illustrated embodiment of FIG. 12C, release member 1242A is shown in a first and unlocked position wherein locking pin 1244B does extend inwardly from side 1203. When locking pin 1244A is not inserted into an aperture formed in member 114 or member 124, seat assembly 140 may slide in either direction on support frame 110 or support frame 120, respectively.

Referring to FIGS. 5 12A, 12B, and 12C, lock assembly 590B comprises a plate-mount, hand retractable spring and ball disposed on rear side 1207 of seat frame 534. In the illustrated embodiment of FIGS. 12A and 12B, locking pin 1244B extends inwardly. When locking pin 1244B is inserted into an aperture formed in member 112 or member 122, seat assembly 140 is prevented from sliding in either direction or disengaging from support frame 110 or support frame 120, respectively.

In the illustrated embodiment of FIG. 12C, release member 1242B is shown in a first and unlocked position wherein locking pin 1244B does extend inwardly from side 1207. When locking pin 1244B is not inserted into an aperture formed in member 114 or member 124, seat assembly 140 may slide in either direction on support frame 110 or support frame 120, respectively. Lock assembly 590*a* and lock assembly 590*b* must be simultaneously placed in an unlocked orientation for seat assembly 140 to be released from either support frame 110 or support frame 120.

Figure 9:
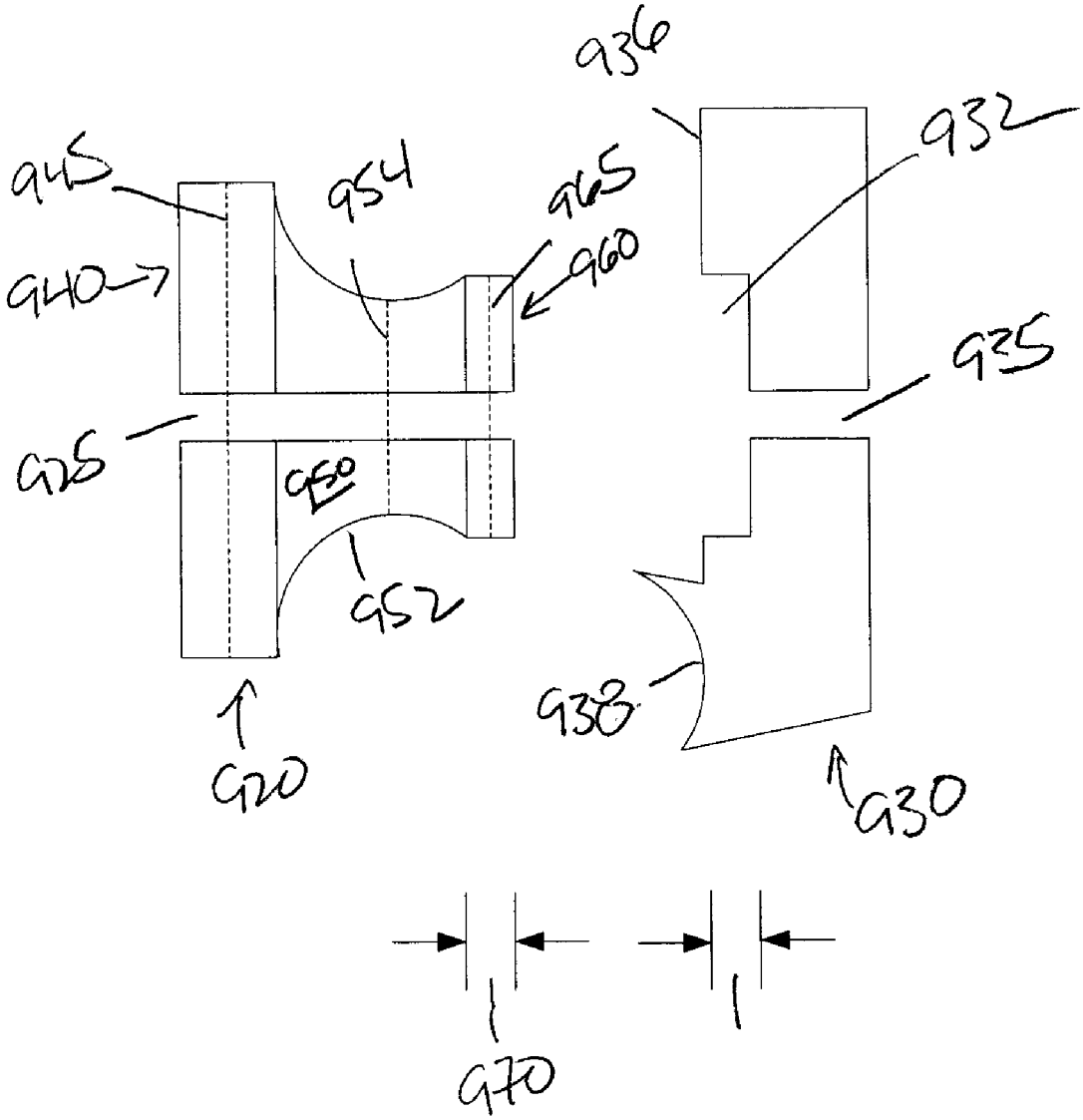
FIG. 9 shows the elements of Applicant's attachment assembly.

FIGS. 12B and 12C show seat frame 534 slideably mounted on members 124 and 126 using attachment assemblies 1000A, 1000B, 1000C, and 1000D. Referring now to FIG. 9, each attachment assembly 1000 comprises a rotatable member 920 and a fixed member 930. Rotatable member 920 is formed to include aperture 925 extending therethrough. Fixed member 930 is formed to include aperture 935 extending therethrough.

Rotatable member 920 comprises a cylinder 940, hub 950 attached to and extending outwardly from cylinder 940, and cylinder 960 attached to and extending outwardly from hub 950. In certain embodiments, cylinder 940, hub 950, and cylinder 960 comprise an integral assembly that is formed by machining a cylindrical block of a rigid plastic, metal, wood, and combinations thereof. In certain embodiments, cylinder 940, hub 950, and cylinder 960 comprise an integral assembly that is formed by injection molding an engineering plastic.

Cylinder 940 comprises a diameter 945 and cylinder 960 comprises a diameter 965, wherein the diameter 945 is greater than the diameter 965. Cylinder 960 comprises a length 970.

Hub 950 comprises a cylinder with an arcuate-shaped wall 954 interconnecting cylinders 940 and 960, wherein a first end of hub 950 comprises diameter 945 and a second end of hub 950 comprises diameter 965. Hub 950 further comprises diameter 954 at a point between the first end and the second end, wherein diameter 954 is less than diameter 965. Surface 952 comprises an arcuate shape comprising a radius of curvature corresponding to the radius of support members 112, 114, 122, 124, 132, and 134.

Fixed member 930 is formed to include a circular aperture 932 extending inwardly from side 936, wherein circular aperture 934 comprises diameter 925 and a depth 934, wherein depth 934 equals length 929. Fixed member 930 further comprises an arcuate surface 938, wherein arcuate surface 938 comprises a radius of curvature corresponding to the radius of support members 112, 114, 122, 124, 132, and 134.

Figure 10:
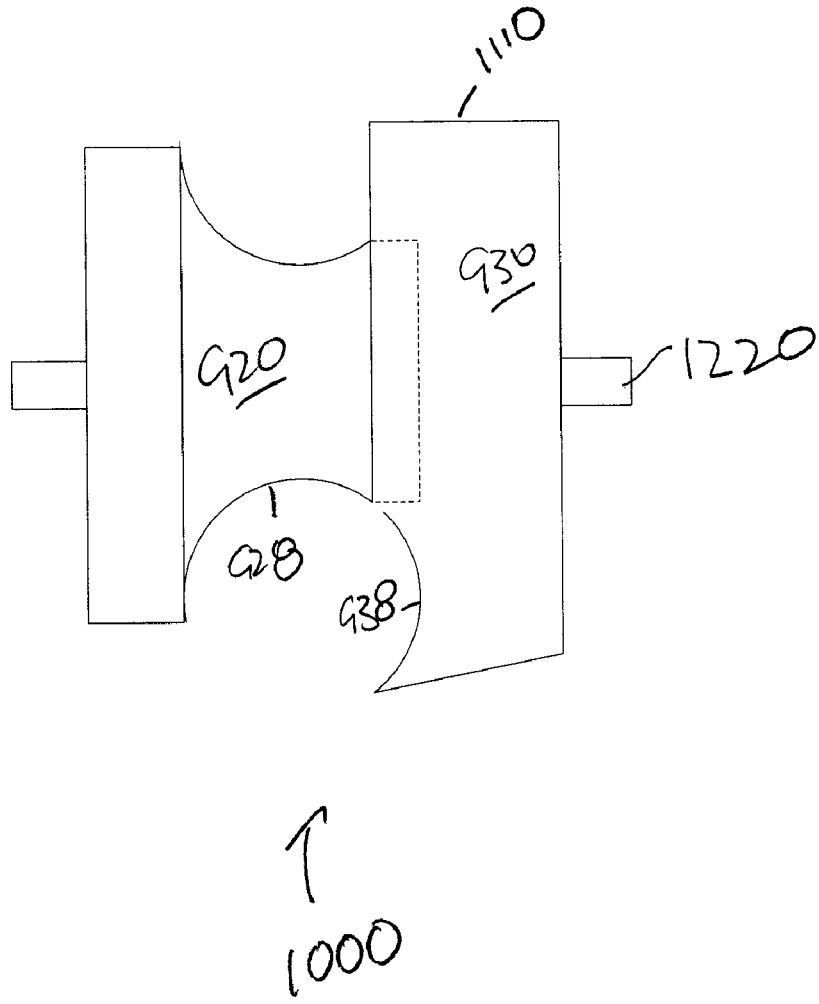
FIG. 10 shows a shaft passing through the elements of FIG. 9.

In the illustrated embodiment of FIG. 10, shaft 1220 extends through aperture 925 (FIG. 9) in rotatable member 920, and through aperture 935 (FIG. 9) in fixed member 930. Rotatable member 920 is positioned such that cylinder 960 (FIG. 9) is rotatably disposed within aperture 932 (FIG. 9).

Figure 11:
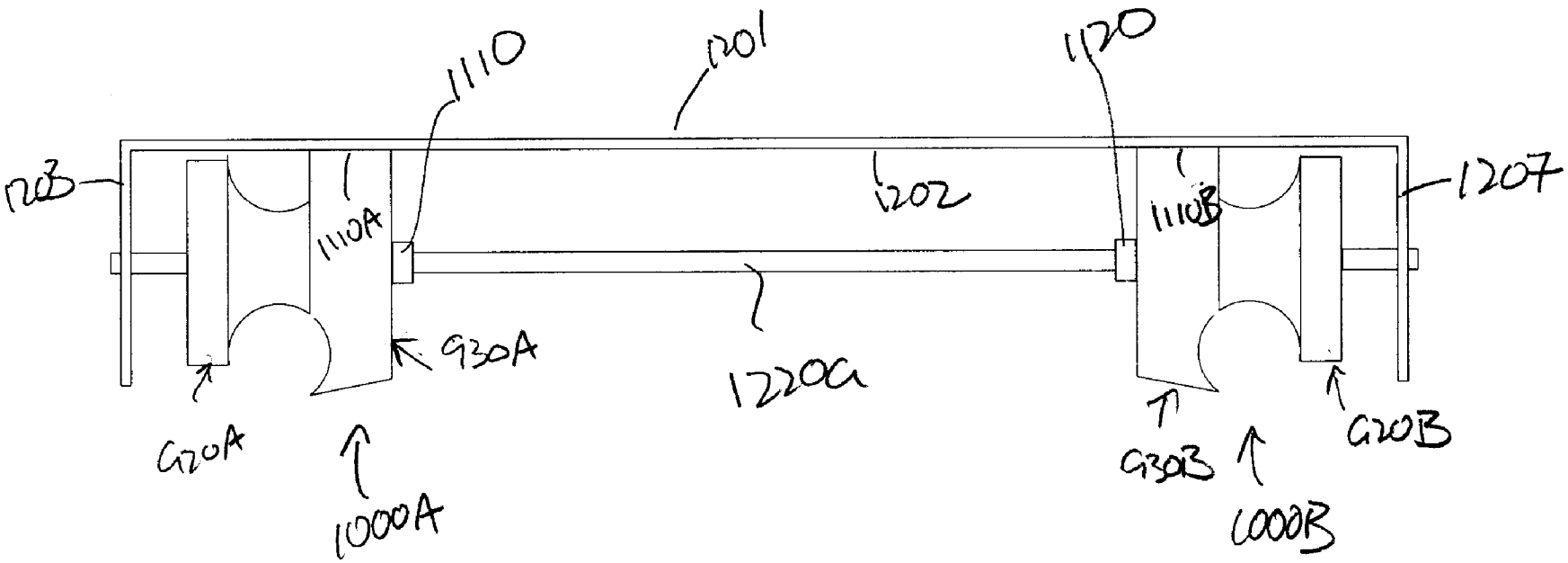
FIG. 11 is a side view of Applicant's seat frame.

Referring now to FIG. 11, shaft 1220*a* extends through aperture 1212 (FIG. 12A) in front 1203 of seat frame 534, and through aperture 1216 in rear 1207 of seat frame 534. In certain embodiments, shaft 1220*a* is rotatably disposed in seat frame 534. Shaft 1220*a* extends through rotatable member 920A, fixed member 930A, rotatable member 920B, and fixed member 930B.

Top 1110A (FIGS. 10, 11) of fixed member 930A is attached to surface 1202 of seat top member 1201, and top 1110B of fixed member 930B is attached to surface 1202 of seat top member 1201. Rotatable members 920A and 920B are rotatably disposed on shaft 1220A, but fixed members 930A and 930B are not rotatably disposed on shaft 1220A.

Similarly, shaft 1220B extends through apertures 1214 and 1218 in seat frame 534. Attachment assembly 1000C is identical to attachment assembly 1000A, wherein attachment assembly 1000C comprises a rotatable member 920 rotatably disposed on shaft 1220B, and a fixed member 930 attached to surface 1202 of seat top member 1201. Attachment assembly 1000D is identical to attachment assembly 1000B, wherein attachment assembly 1000D comprises a rotatable member 920 rotatably disposed on shaft 1220B, and a fixed member 930 attached to surface 1202 of seat top member 1201.

Figure 13A:
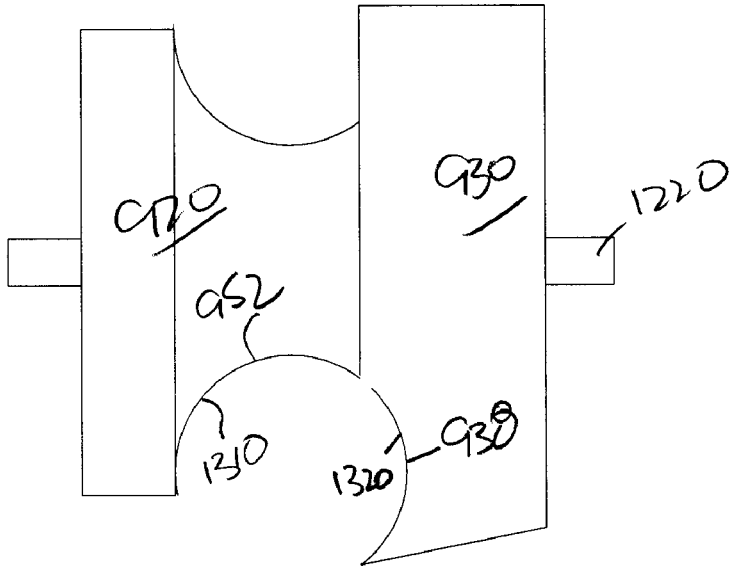
FIG. 13A is a side view of Applicant's attachment assembly showing an aggregate arcuate surface formed by a first arcuate surface and a second arcuate surface.
Figure 13B:
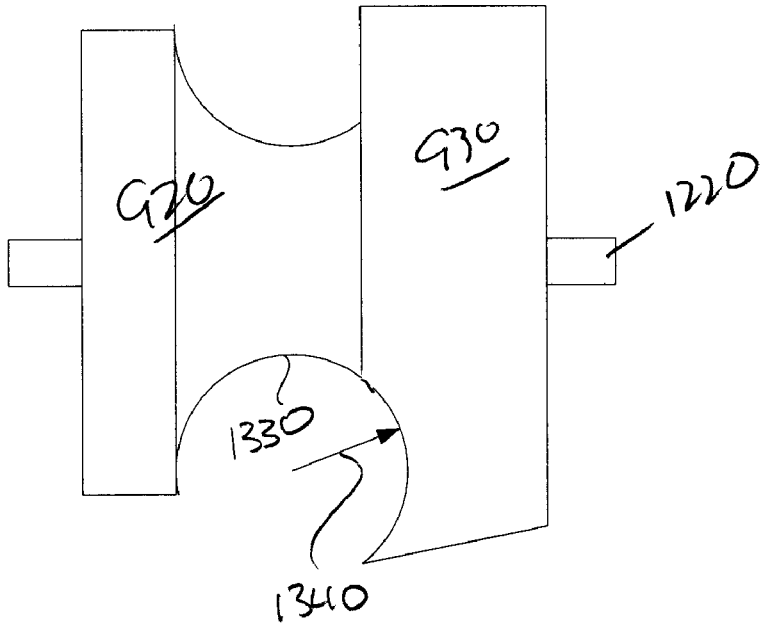
FIG. 13B shows the radius of curvature of the aggregate arcuate surface of FIG. 13A.

Referring now to FIGS. 9, 10, 13A, and 13B, in the illustrated embodiment of FIGS. 13A and 13B, rotatable member 920 is shown having cylinder 960 rotatable inserted into aperture 932 such that arcuate surface 952 having length 1310 abuts arcuate surface 938 having length 1320 to form an aggregate arcuate surface comprising a length 1330 and a radius of curvature 1340, wherein aggregate length 1330 equals length 1310 plus length 1320.

Figure 13C:
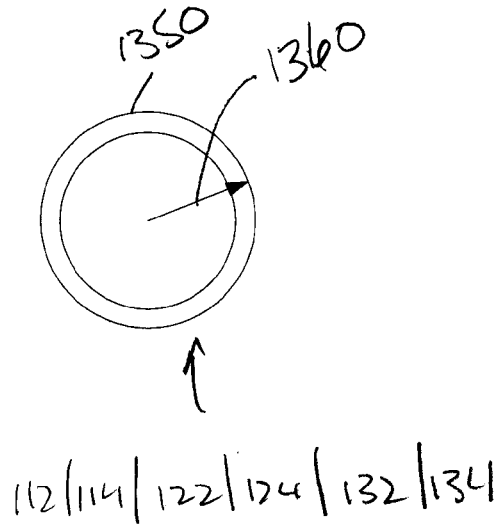
FIG. 13C shows the radius of curvature of a plurality of Applicant's support rails.
Figure 13D:
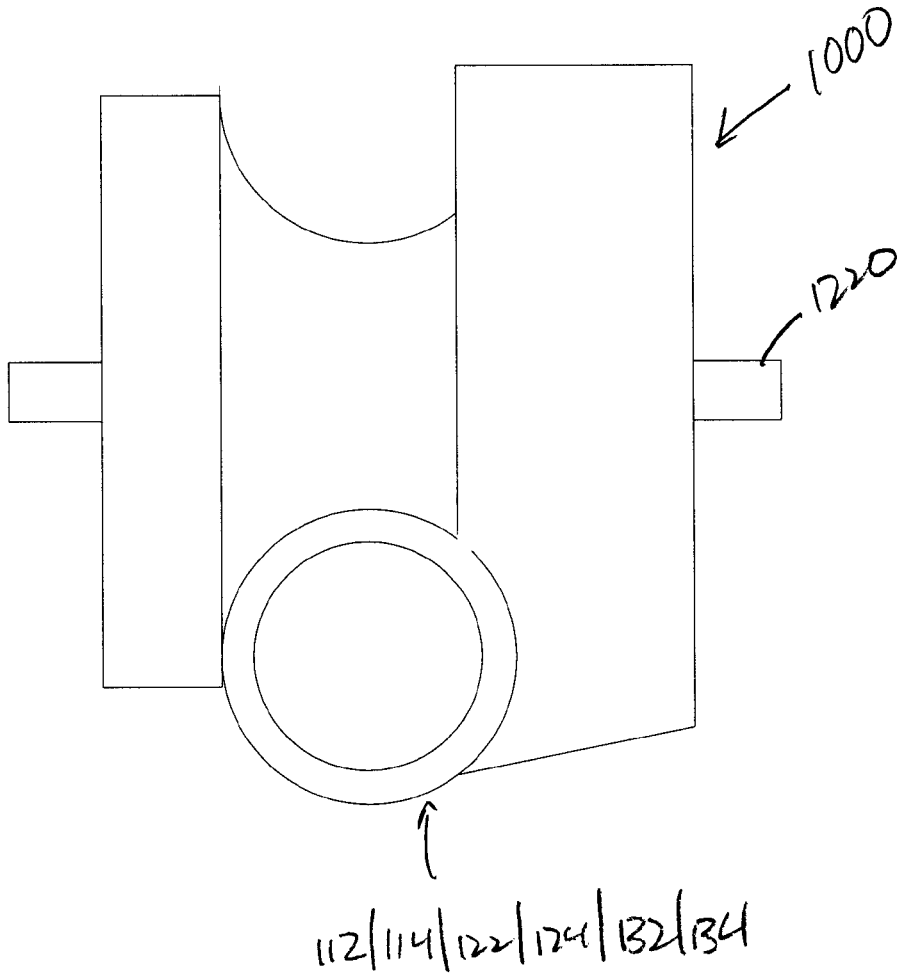
FIG. 13D shows one of Applicant's attachment assembly releasably attached to one of Applicant's support rails.

Referring now to FIG. 13C, in certain embodiments support members 112, 114, 122, 124, 132, and 134, comprises tubular members having an outer radius 1360 and an outer circumference 1350, wherein that outer radius 1360 equals the radius of curvature 1340 (FIG. 13B). FIG. 13D a support member selected from the group consisting of support member 112, support member 114, support member 122, support member 124, support member 132, and support member 134, releasably attached to attachment assembly 1000. In certain embodiments, length 1330 of the aggregate arcuate surface formed by arcuate surface 952 and arcuate surface 938 is greater than (0.50) (outer circumference 1350). In certain embodiments, length 1330 of the aggregate arcuate surface formed by arcuate surface 952 and arcuate surface 938 is about (0.67) (outer circumference 1350). In certain embodiments, length 1330 of the aggregate arcuate surface formed by arcuate surface 952 and arcuate surface 938 is about (0.75) (outer circumference 1350).

Referring now to FIGS. 12B, 12C, and 13D, more than fifty percent (50%) of the surface area of support member 122 in contact with attachment assembly 1000B is encircled by attachment assembly 1000B. Similarly, more than fifty percent (50%) of the surface area of support member 122 in contact with attachment assembly 1000D is encircled by attachment assembly 1000D. In addition, more than fifty percent (50%) of the surface area of support member 124 in contact with attachment assembly 1000A is encircled by attachment assembly 1000A. Moreover, more than fifty percent (50%) of the surface area of support member 122 in contact with attachment assembly 1000C is encircled by attachment assembly 1000C.

Applicant's attachment assemblies 1000A, 1000B, 1000C, and 1000D, releasably attach seat assembly 140 to first support frame 110, second support frame 120, and mechanical interface 130. Applicant's attachment assemblies 1000A, 1000B, 1000C, and 1000D, snap onto support members 112/144, or 122/124, or 132/134. Once attachment assemblies 1000A, 1000B, 1000C, and 1000D, are engaged with a set of support rails, seat assembly 140 is both securely and moveably attached to that set of support rails. Seat assembly 140 cannot be inadvertently disengaged from a set of support rails. In order to remove seat assembly 140 from a set of support rails, each of attachment assemblies 1000A, 1000B, 1000C, and 1000D, must be manually disengaged from one of the two support rails. As a result, if the user leans forwardly or backwardly in seat assembly 140, that seat assembly 140 will not inadvertently falls off of first support frame 110, second support frame 120, or mechanical interface 130.

While the preferred embodiments of the present invention have been illustrated in detail, it should be apparent that modifications and adaptations to those embodiments may occur to one skilled in the art without departing from the scope of the present invention as set forth in the following claims.

I claim:

1. A portable commode, shower, and bath wheelchair apparatus, comprising:

a first support frame comprising a first support rail, a second support rail, and four first leg assemblies, wherein the length of each first leg assembly can be separately adjusted, and wherein each first leg assembly comprises a wheel disposed on a distal end, and wherein a proximal end of each first leg assembly is hingedly attached to a different end of a different one of said first support rail and said second support rail, and wherein each first leg assembly can be moved, without using any tools, from a first configuration to second configuration, and from said second configuration to said first configuration wherein when a first leg assembly is placed in said first configuration the leg assembly is disposed within said first support frame, and when a first leg assembly is placed in said second configuration the leg assembly extends outwardly from said first support frame;

a second support frame comprising a third support rail, a fourth support rail, and four second leg assemblies, wherein the length of each second leg assembly can be separately adjusted, and wherein each second leg assembly comprises a glide disposed on a distal end, and wherein a proximal end of each second leg assembly is hingedly attached to a different end of a different one of said third support rail or said fourth support rail, and wherein each second leg assembly can be moved, without using any tools, from a first configuration to second configuration, and from said second configuration to said first configuration, wherein when a second leg assembly is placed in said first configuration the leg assembly is disposed within said second support frame, and when a second leg assembly is placed in said second configuration the leg assembly extends outwardly from said second support frame;

a mechanical interface comprising a first interface assembly comprising a fifth support rail, a first connector disposed on a first end of said fifth support rail, and a second connector disposed a second end of said fifth support rail, a second interface assembly comprising a sixth support rail, a third connector disposed on a first end of said sixth support rail, and a fourth connector disposed a second end of said sixth support rail;

wherein said first connector can be releasably attached to said first support rail without using any tools, and wherein said second connector can be releasably attached to said third support rail without using any tools, such that said first support rail and said fifth support rail and said third support rail comprise a first contiguous support rail; and wherein said third connector can be releasably attached to said second support rail without using any tools, and wherein said fourth connector can be releasably attached to said fourth support rail without using any tools, such that said second support rail and said sixth support rail and said fourth support rail comprise a second contiguous support rail;

a seat assembly comprising a plurality of attachment assemblies, wherein said seat assembly can be slidingly attached to both said first contiguous support rail and to said second contiguous support rail by said plurality of attachment assemblies wherein:

said first support member, said second support member, said third support member, said fourth support member, said fifth support member, and said sixth support member, each comprise an identical support member radius of curvature and an identical support member circumference;

each of said plurality of attachment assemblies comprises an identical aggregate arcuate surface, wherein said aggregate arcuate surface comprises an aggregate arcuate surface radius of curvature and an aggregate arcuate surface length;

said support member radius of curvature equals said aggregate arcuate surface radius of curvature;

said aggregate arcuate surface length is greater than the multiplication product of (0.5) and said support member circumference said first support member, said second support member, said third support member, said fourth support member, said fifth support member, and said sixth support member, each comprise a cylindrical member.

2. The portable commode, shower, and bath wheelchair apparatus of claim 1, wherein said arcuate surface length is less than or equal to the multiplication product of (0.67) and said support member circumference.

3. The portable commode, shower, and bath wheelchair apparatus of claim 1, wherein said aggregate arcuate surface length is less than or equal to the multiplication product of (0.75) and said support member circumference.

4. The portable commode, shower, and bath wheelchair apparatus of claim 1, wherein each of said plurality of attachment assemblies comprises:

a rotatable member formed to include a first aperture therethrough, wherein said rotatable member comprises a first arcuate surface, and wherein said rotatable member is rotatably disposed about a shaft passing through said first aperture;

a fixed member formed to include a second aperture therethrough, wherein said fixed member comprises a second arcuate surface, and wherein said shaft passes through said second aperture, and wherein said fixed member is not rotatably disposed about said shaft;

wherein said first arcuate surface contacts said second arcuate surface to form said aggregate arcuate surface.

5. The portable commode, shower, and bath wheelchair apparatus of claim 4, wherein said plurality of attachment assemblies comprise four attachment assemblies, and wherein said seat assembly further comprises:

a seat frame comprising a rectangular top and a front side and a rear side attached to said top and extending downwardly therefrom, wherein said front side is formed to include a first aperture and a second aperture, and wherein said rear side is formed to include a third aperture and a fourth aperture;

a first circular shaft extending through said first aperture and extending through said third aperture;

a second circular shaft extending through said second aperture and extending through said fourth aperture;

a first rotatable member rotatably disposed about said first circular shaft;

a first fixed member attached to said rectangular top and in contact with said first rotatable member;

a second rotatable member rotatably disposed about said first circular shaft;

a second fixed member attached to said rectangular top and in contact with said second rotatable member;

a third rotatable member rotatably disposed about said second circular shaft;

a third fixed member attached to said rectangular top and in contact with said third rotatable member;

a fourth rotatable member rotatably disposed about said second circular shaft;

a fourth fixed member attached to said rectangular top and in contact with said fourth rotatable member.

6. The portable commode, shower, and bath wheelchair apparatus of claim 5, wherein said seat frame further comprises a first lock assembly disposed on said front side, wherein said first lock assembly comprises a first release member extending outwardly from said front side and a first locking pin, wherein when said first release member is placed in a first configuration said first locking pin extends inwardly from said front side, and wherein when said first release member is placed in a second configuration said first locking pin does not extend inwardly from said front side.

7. The portable commode, shower, and bath wheelchair apparatus of claim 6, wherein said seat frame further comprises a second lock assembly disposed on said rear side, wherein said second lock assembly comprises a second release member extending outwardly from said rear side and a second locking pin, wherein when said second release member is placed in a first configuration said second locking pin extends inwardly from said front side, and wherein when said second release member is placed in a second configuration said second locking pin does not extend inwardly from said rear side.

8. A method to make a commode, shower, and bath transfer system, comprising the steps of:

supplying a first support frame comprising a first support rail, a second support rail, and four first leg assemblies, wherein the length of each first leg assembly can be separately adjusted, and wherein each first leg assembly comprises a wheel disposed on a distal end, and wherein a proximal end of each first leg assembly is hingedly attached to a different end of a different one of said two support rails, and wherein each first leg assembly can be moved, without using any tools, from a first configuration to second configuration, and from said second configuration to said first configuration wherein when a first leg assembly is placed in said first configuration the leg assembly is disposed within said first support frame, and when a first leg assembly is placed in said second configuration the leg assembly extends outwardly from said first support frame;

placing each of said first leg assemblies in said second configuration;

supplying a second support frame comprising a third support rail, a fourth support rail, and four second leg assemblies, wherein the length of each second leg assembly can be separately adjusted, and wherein each second leg assembly comprises a glide disposed on a distal end, and wherein a proximal end of each second leg assembly is hingedly attached to a different end of a different one of said third support rail or said fourth support rail, and wherein each second leg assembly can be moved, without using any tools, from a first configuration to second configuration, and from said second configuration to said first configuration, wherein when a second leg assembly is placed in said first configuration the leg assembly is disposed within said second support frame, and when a second leg assembly is placed in said second configuration the leg assembly extends outwardly from said second support frame;

placing each of said second leg assemblies in said second configuration;

disposing two of said second leg assemblies into a bath tub;

supplying a mechanical interface comprising a first interface assembly comprising a fifth support rail, a first connector disposed on a first end of said fifth support rail, and a second connector disposed a second end of said fifth support rail, a second interface assembly comprising a sixth support rail, a third connector disposed on a first end of said sixth support rail, and a fourth connector disposed a second end of said sixth support rail;

releasably attaching said first connector to said first support rail;

releasably attaching said second connector to said third support rail, such that said first support rail and said fifth support rail and said third support rail comprise a first contiguous support rail;

releasably attaching said third connector to said second support rail;

releasably attaching said fourth connector to said fourth support rail, such that said second support rail and said sixth support rail and said fourth support rail comprise a second contiguous support rail;

supplying a seat assembly comprising a plurality of attachment assemblies;

slidingly attaching said seat assembly to said first support rail and to said second support by said plurality of attachment assemblies;

wherein:

said seat assembly can be slidingly moved across said mechanical interface between said first support frame and said second support frame;

said first support member, said second support member, said third support member, said fourth support member, said fifth support member, and said sixth support member, each comprise a cylindrical member;

said first support member, said second support member, said third support member, said fourth support member, said fifth support member, and said sixth support member, each comprise an identical support member radius of curvature and an identical support member circumference;

each of said plurality of attachment assemblies comprises an identical aggregate arcuate surface, wherein said aggregate arcuate surface comprises an aggregate arcuate surface radius of curvature and an aggregate arcuate surface length;

said support member radius of curvature equals said aggregate arcuate surface radius of curvature;

said aggregate arcuate surface length is greater than the multiplication product of (0.5) and said support member circumference.

* * * * *